US009192823B2

(12) United States Patent
Cole et al.

(10) Patent No.: US 9,192,823 B2
(45) Date of Patent: Nov. 24, 2015

(54) GOLF COUPLING MECHANISMS AND RELATED METHODS

(71) Applicant: Karsten Manufacturing Corporation, Phoenix, AZ (US)

(72) Inventors: Eric V. Cole, Phoenix, AZ (US); Martin R. Jertson, Phoenix, AZ (US); Ryan M. Stokke, Phoenix, AZ (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 46 days.

(21) Appl. No.: 13/735,123

(22) Filed: Jan. 7, 2013

(65) Prior Publication Data

US 2013/0123038 A1 May 16, 2013

Related U.S. Application Data

(63) Continuation-in-part of application No. 13/468,677, filed on May 10, 2012, now Pat. No. 8,419,567, and a continuation-in-part of application No. 13/468,663, filed on May 10, 2012, now Pat. No. 8,926,447, and a continuation-in-part of application No. 13/468,675, filed on May 10, 2012, now Pat. No. 8,932,147, said application No. 13/468,677 is a continuation-in-part of application No. 13/429,319, filed on Mar. 24, 2012, now Pat. No. 8,790,191, said application No. 13/468,663 is a continuation-in-part of application No. 13/429,319, said application No. 13/468,675 is a continuation-in-part of application No. 13/429,319.

(60) Provisional application No. 61/529,880, filed on Aug. 31, 2011, provisional application No. 61/590,232, filed on Jan. 24, 2012.

(51) Int. Cl.

| | |
|---|---|
| ***A63B 53/02*** | (2006.01) |
| ***A63B 53/06*** | (2015.01) |
| ***A63B 53/04*** | (2015.01) |

(52) U.S. Cl.

CPC ..... *A63B 53/02* (2013.01); *A63B 53/04* (2013.01); *A63B 53/0466* (2013.01); *A63B 53/06* (2013.01); *A63B 53/047* (2013.01); *A63B 53/0487* (2013.01); *A63B 2053/023* (2013.01); *A63B 2053/0437* (2013.01); *A63B 2225/01* (2013.01)

(58) Field of Classification Search

CPC ..... A63B 53/02; A63B 53/06; A63B 53/04; A63B 53/0466; A63B 2053/023; A63B 2053/0437; A63B 53/047; A63B 53/0487; A63B 2225/01

USPC ..... 473/244–248, 288, 307, 309

See application file for complete search history.

(56) References Cited

U.S. PATENT DOCUMENTS

| | | | |
|---|---|---|---|
| 4,948,132 | A | 8/1990 | Wharton |
| 6,623,374 | B1 | 9/2003 | Helmstetter et al. |
| 7,300,359 | B2 | 11/2007 | Hocknell et al. |

(Continued)

FOREIGN PATENT DOCUMENTS

| | | |
|---|---|---|
| GB | 2241173 | 8/1991 |
| GB | 2363340 | 12/2001 |

(Continued)

*Primary Examiner* — Stephen Blau

(57) ABSTRACT

Embodiments of golf coupling mechanisms are presented herein. Other examples and related methods are also disclosed herein.

20 Claims, 19 Drawing Sheets

(56) References Cited

U.S. PATENT DOCUMENTS

| | | | | |
|---|---|---|---|---|
| 7,699,717 | B2 | 4/2010 | Morris et al. | |
| 7,789,769 | B2 | 9/2010 | Sugimoto | |
| 7,892,105 | B2 | 2/2011 | Galloway | |
| 7,922,599 | B2 | 4/2011 | Yamamoto | |
| 7,931,542 | B2 | 4/2011 | Kusumoto | |
| 7,963,855 | B2 | 6/2011 | Sander et al. | |
| 8,002,644 | B2 | 8/2011 | Hocknell et al. | |
| 8,029,383 | B2 | 10/2011 | Yamamoto | |
| 8,088,019 | B1 * | 1/2012 | Long et al. | 473/245 |
| 8,177,661 | B2 | 5/2012 | Beach et al. | |
| 8,182,357 | B2 | 5/2012 | Moore | |
| 8,235,834 | B2 * | 8/2012 | De La Cruz et al. | 473/307 |
| 8,257,197 | B2 | 9/2012 | Schweigert | |
| 8,262,499 | B2 | 9/2012 | Murphy | |
| 8,287,400 | B2 | 10/2012 | Thomas | |
| 8,491,408 | B2 | 7/2013 | Beach et al. | |
| 8,523,701 | B2 | 9/2013 | Knutson et al. | |
| 8,535,173 | B2 | 9/2013 | Golden et al. | |
| 8,616,995 | B2 | 12/2013 | Thomas et al. | |
| 8,636,606 | B2 | 1/2014 | Sato | |
| 8,876,626 | B2 | 11/2014 | Suwa et al. | |
| 2006/0281577 | A1 | 12/2006 | Owens | |
| 2008/0293510 | A1 | 11/2008 | Yamamoto | |
| 2009/0197698 | A1 | 8/2009 | Morris et al. | |
| 2009/0197699 | A1 | 8/2009 | Morris et al. | |
| 2009/0275423 | A1 | 11/2009 | Yamamoto | |
| 2010/0035700 | A1 | 2/2010 | Yu et al. | |
| 2010/0130306 | A1 | 5/2010 | Schweigert | |
| 2010/0144459 | A1 | 6/2010 | Sato et al. | |
| 2010/0197424 | A1 | 8/2010 | Beach et al. | |
| 2010/0255927 | A1 | 10/2010 | Evans | |
| 2011/0118045 | A1 | 5/2011 | Sato et al. | |
| 2011/0118051 | A1 | 5/2011 | Thomas | |
| 2011/0152000 | A1 | 6/2011 | Sargent et al. | |
| 2012/0034996 | A1 | 2/2012 | Murphy et al. | |
| 2012/0071261 | A1 | 3/2012 | Yamamoto | |
| 2012/0225731 | A1 * | 9/2012 | Suwa et al. | 473/314 |
| 2014/0080617 | A1 * | 3/2014 | Llewellyn et al. | 473/246 |

FOREIGN PATENT DOCUMENTS

| | | |
|---|---|---|
| JP | 2001017584 | 1/2001 |
| JP | 2003070940 | 3/2003 |
| JP | 3154639 U | 10/2009 |
| WO | WO 2007/021160 | 2/2007 |

* cited by examiner

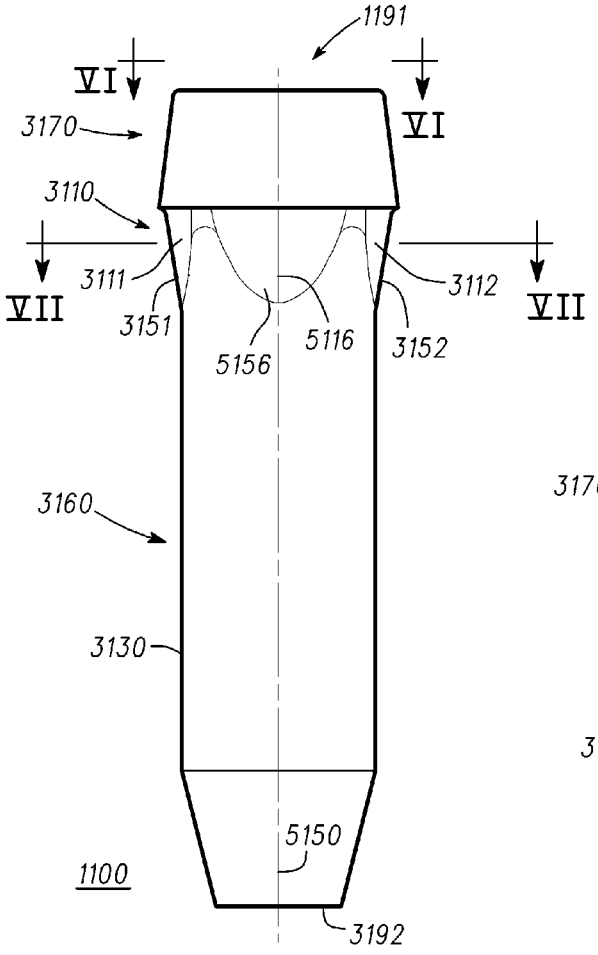
Fig. 5
Fig. 6
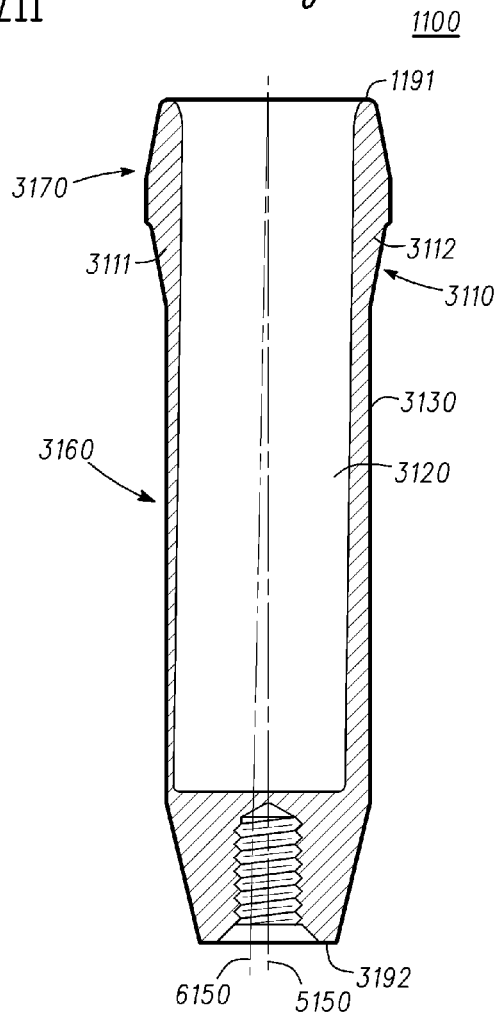

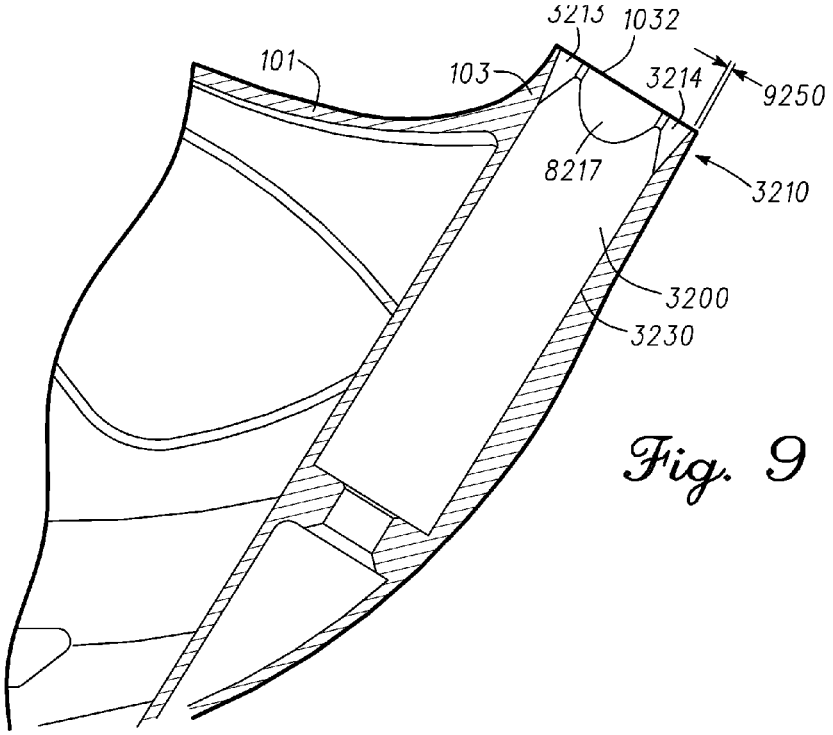
Fig. 9
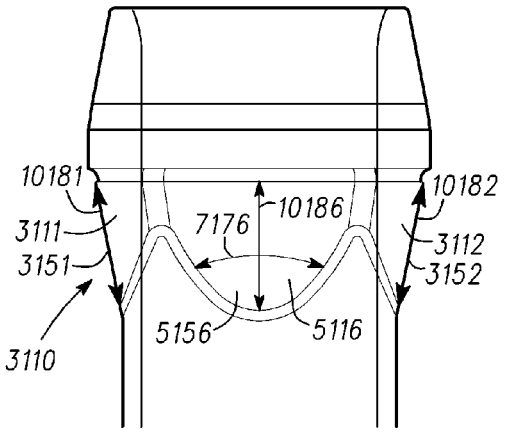
1100 Fig. 10
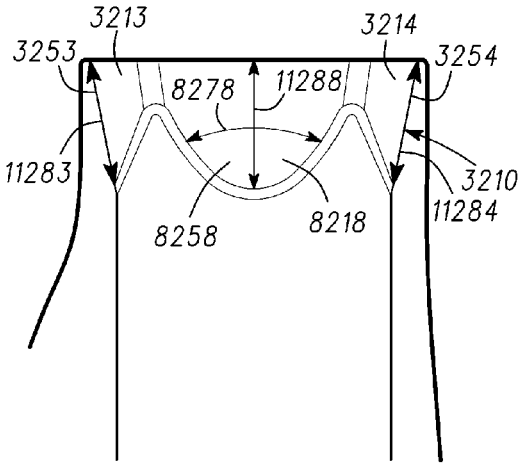
Fig. 11 3200

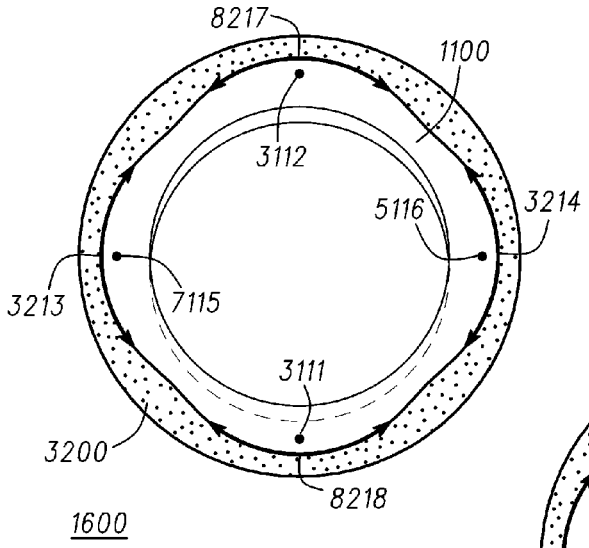
Fig. 16
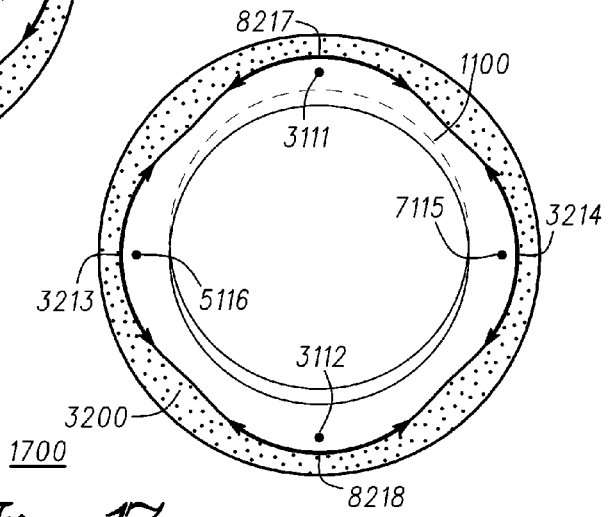
Fig. 17
Fig. 18
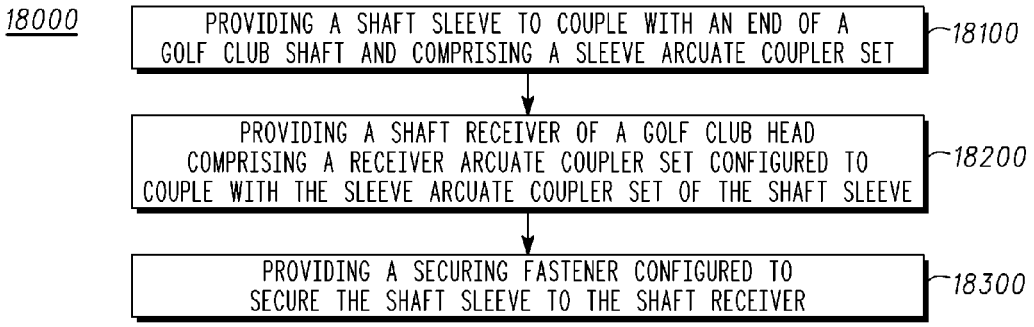

GOLF COUPLING MECHANISMS AND RELATED METHODS

CROSS-REFERENCE TO RELATED APPLICATIONS

This application is a continuation-in-part of U.S. patent application Ser. No. 13/468,677, filed May 10, 2012, of U.S. patent application Ser. No. 13/468,663, filed May 10, 2012, and of U.S. patent application Ser. No. 13/468,675, filed May 10, 2012, each of which is a continuation-in-part of U.S. patent application Ser. No. 13/429,319, filed on Mar. 24, 2012, which claims the benefit of U.S. Provisional Patent Application No. 61/529,880, filed on Aug. 31, 2011, and of U.S. Provisional Patent Application No. 61/590,232, filed on Jan. 24, 2012. The disclosures of the referenced applications are incorporated herein by reference.

TECHNICAL FIELD

The present disclosure relates generally to sports equipment, and relates, more particularly, to golf coupling mechanisms and related methods.

BACKGROUND

Several sports, like golf, require equipment with features that can be selected or custom-fit to an individual's characteristics or preferences. For example, the recommended type of club shaft, type of club head, and/or the loft or lie angle of the club head may vary based on the individual's characteristics, such as skill, age or height. Once assembled, however, golf clubs normally have fixed, unchangeable coupling mechanisms between their golf club shafts and golf club heads. Accordingly, when determining suitable equipment for the individual, an unnecessarily large number of golf clubs with such fixed coupling mechanisms must be available to test different combinations of club shafts, club heads, loft angles, and/or lie angles. In addition, if the individual's characteristics or preferences were to change, his golf equipment would not be adjustable to account for such changes. Adjustable coupling mechanisms can be configured to provide such flexibility in changeably setting different features of golf clubs, but may introduce instabilities leading to lack of cohesion or concentrations of stress at the golf club head and golf club shaft coupling. Considering the above, further developments in golf coupling mechanisms and related methods will enhance utilities and adjustability features for golf clubs.

BRIEF DESCRIPTION OF THE DRAWINGS

The present disclosure may be better understood from a reading of the following detailed description of examples of embodiments, taken in conjunction with the accompanying figures.

FIG. 5 illustrates a side view of the shaft sleeve decoupled from the golf club head.

FIG. 6 illustrates a cross sectional view of the shaft sleeve along cross-sectional line VI-VI of FIG. 5.

FIG. 9 illustrates a side cross-sectional side view of the golf club head of FIG. 1 along cross-sectional line III-III of FIG. 2, with the shaft sleeve removed therefrom.

FIG. 10 illustrates a side view of a portion of a sleeve coupler set of the shaft sleeve.

FIG. 11 illustrates a side x-ray view of a portion a receiver coupler set of the shaft receiver.

FIG. 16 illustrates a top cross-sectional view of the golf coupling mechanism in a third configuration, with respect to the viewpoint of with the shaft sleeve removed therefrom line XIV-XIV of FIG. 4.

FIG. 17 illustrates a top cross-sectional view of the golf coupling mechanism in a fourth configuration, with respect to the viewpoint of with the shaft sleeve removed therefrom line XIV-XIV of FIG. 4.

FIG. 18 illustrates a flowchart for a method that can be used to provide, form, and/or manufacture a golf coupler mechanism in accordance with the present disclosure.

Figure 1:
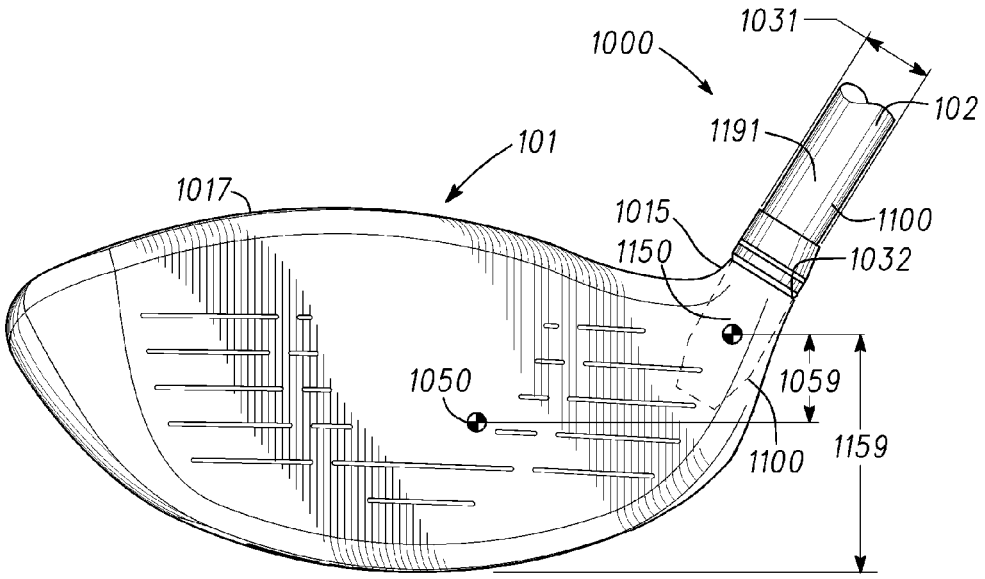
FIG. 1 illustrates a front perspective view of a golf club head with a golf coupling mechanism according to one example of the present disclosure.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

As defined herein, two or more elements are "integral" if they are comprised of the same piece of material. As defined herein, two or more elements are "non-integral" if each is comprised of a different piece of material.

DETAILED DESCRIPTION

In one example, a golf coupling mechanism for a golf club head and a golf club shaft can comprise a shaft sleeve configured to be coupled to an end of the golf club shaft. The shaft sleeve can comprise a shaft bore configured to receive the end of the golf club shaft, a sleeve axis extending along a longitudinal centerline of the shaft sleeve, from a sleeve top end to a sleeve bottom end of the shaft sleeve, a sleeve outer wall centered about the sleeve axis, a first coupler protruding from the sleeve outer wall, and a second coupler protruding from the sleeve outer wall. The first coupler can comprise a first arcuate surface curved throughout the first coupler. The second coupler can comprise a second arcuate surface curved throughout the second coupler. The first and second arcuate surfaces can be configured to restrict a rotation of the shaft sleeve relative to the golf club head.

In one example, a method for providing a golf coupling mechanism can comprise providing a shaft sleeve configured to be coupled to an end of a golf club shaft. Providing the shaft sleeve can comprise providing a sleeve axis extending along a longitudinal centerline of the shaft sleeve, from a sleeve top end to a sleeve bottom end of the shaft sleeve, providing a sleeve outer wall a sleeve outer wall centered about the sleeve axis, providing a first coupler protruding from the sleeve outer wall, and providing a second coupler protruding from the sleeve outer wall. Providing the first coupler can comprise providing a first arcuate surface curved throughout the first coupler. Providing the second coupler can comprise providing a second arcuate surface curved throughout the second coupler. Wherein the first and second arcuate surfaces can be configured to restrict a rotation of the shaft sleeve relative to a golf club head.

In one example, a golf club can comprise a golf club head, a golf club shaft, and a golf coupling mechanism for coupling the golf club head and the golf club shaft together. The golf coupling mechanism can comprises a shaft sleeve configured to be coupled to an end of the golf club shaft, and a shaft receiver of the golf club head configured to receive the shaft sleeve. The shaft sleeve can comprise a sleeve axis extending along a longitudinal centerline of the shaft sleeve, from a sleeve top end to a sleeve bottom end of the shaft sleeve, a shaft bore non-coaxial to the sleeve axis and configured to receive the end of the golf club shaft, a sleeve outer wall centered about the sleeve axis, a sleeve insertion portion bounded by the sleeve outer wall and configured to be inserted into the shaft receiver, a first coupler protruding from the sleeve outer wall, and a second coupler protruding from the sleeve outer wall. The shaft receiver can comprise a receiver inner wall configured to bound the sleeve outer wall when the sleeve insertion portion is in the shaft receiver, a third coupler indented into the receiver inner wall, and a fourth coupler indented into the receiver inner wall. The first coupler comprises a first arcuate surface curved throughout the first coupler. The first arcuate surface can comprise a first vertical radius of curvature of at least approximately 10.1 mm and a first horizontal radius of curvature of approximately 2.5 mm to approximately 5.7 mm. The second coupler can comprise a second arcuate surface curved throughout the second coupler. The second arcuate surface can comprise a second vertical radius of curvature of at least approximately 10.1 mm and a second horizontal radius of curvature of approximately 2.5 mm to approximately 5.7 mm. The third coupler can comprise a third arcuate surface complementary with at least a portion of the third arcuate surface of the first coupler. The third arcuate surface can comprise a third vertical radius of curvature of at least approximately 10.1 mm and a third horizontal radius of curvature of approximately 2.5 mm to approximately 5.7 mm. The fourth coupler can comprise a fourth arcuate surface complementary with at least a portion of the second arcuate surface of the second coupler. The fourth arcuate surface can comprise a fourth vertical radius of curvature of at least approximately 10.1 mm and a fourth horizontal radius of curvature of approximately 2.5 mm to approximately 5.7 mm. The first, second, third, and fourth arcuate surfaces can be configured to restrict a rotation of the shaft sleeve relative to the golf club head.

In one example, a golf club head can comprise a head body, a hosel at the head body, a shaft sleeve removable from the hosel, and an adjustment mechanism comprising at least one of a first pivoting mechanism or a first washer securing mechanism. The shaft sleeve can comprise a sleeve bore configured to receive an end of a golf club shaft, a sleeve axis extending along a longitudinal centerline of the sleeve bore, a sleeve top portion comprising a sleeve top end, a sleeve insertion portion insertable into the hosel and comprising a sleeve wall bounding the sleeve bore, and a sleeve top coupler bounding the shaft sleeve between the sleeve top portion and the sleeve insertion portion. The hosel can comprise a hosel inner wall defining a hosel bore configured to receive the sleeve insertion portion of the shaft sleeve, a hosel axis extending along a longitudinal centerline of the hosel bore, and a hosel top portion atop the hosel inner wall and comprising a hosel top coupler configured to couple with the sleeve top coupler when the shaft sleeve is located in the hosel. The first pivoting mechanism can comprise the sleeve top coupler comprising an arcuate joint surface substantially conforming to a spherical segment shape, and the hosel top coupler comprising an arcuate socket surface substantially conforming to the spherical segment shape such that, when the sleeve insertion portion is in the hosel bore, the arcuate joint surface of the sleeve top coupler and the arcuate socket surface of the hosel top coupler are configured to slidably seat against each other, thereby defining a pivot junction therebetween to enable displacement of the sleeve insertion portion along a plurality of planes within the hosel bore. The first washer securing mechanism can comprise a sleeve bottom coupler at a bottom of the shaft sleeve, a locking surface of the head body, a passageway located at a bottom end of the hosel, linking the hosel bore to the locking surface of the head body, and bounded by a passageway perimeter at the locking surface (the passageway perimeter comprising a passageway centerpoint), a fastener configured to engage the sleeve bottom coupler via the passageway to pull the sleeve top coupler and the hosel top coupler against each other and to secure the sleeve axis relative to the hosel axis, and a first washer located between the fastener and the locking surface. The first washer can comprise a first washer side comprising a first washer form having a shape that is noncircular and complementary with the passageway perimeter, a second washer side opposite the first washer side, and a first washer channel extending from the first washer side to the second washer side. The first washer form can be configured to engage the passageway perimeter in a first orientation configured to position the first washer channel at a first location, relative to the passageway centerpoint, for setting the sleeve axis at a first angle relative to the hosel axis when the fastener and the sleeve bottom coupler engage each other via the passageway and the first washer channel.

In one example, a golf club head can comprise a head body, a hosel at the head body, and a shaft sleeve removable from the hosel. The shaft sleeve can comprise a sleeve bore configured to receive an end of a golf club shaft, a sleeve axis extending along a longitudinal centerline of the sleeve bore, a sleeve top portion comprising a sleeve top end, a sleeve insertion portion insertable into the hosel and comprising a sleeve wall bounding the sleeve bore, and a sleeve top coupler bounding the shaft sleeve between the sleeve top portion and the sleeve insertion portion. The sleeve top coupler can comprise an arcuate joint surface substantially conforming to a spheroidal segment shape.

In one example, a method for providing a golf club head can comprise providing a head body, providing a hosel at the head body, and providing a shaft sleeve removable from the hosel. Providing the shaft sleeve can comprise providing a sleeve bore configured to receive an end of a golf club shaft, providing a sleeve axis extending along a longitudinal centerline of the sleeve bore, providing a sleeve top portion comprising a sleeve top end, providing a sleeve insertion portion insertable into the hosel and comprising a sleeve wall bounding the sleeve bore, and providing a sleeve top coupler bounding the shaft sleeve between the sleeve top portion and the sleeve insertion portion. Providing the sleeve top coupler can comprise providing an arcuate joint surface substantially conforming to a spheroidal segment shape. Providing the hosel can comprise providing a hosel inner wall defining a hosel bore configured to receive the sleeve insertion portion of the shaft sleeve, providing a hosel axis extending along a longitudinal centerline of the hosel bore, and providing a hosel top portion above the hosel inner wall and comprising a hosel top coupler configured to couple with the sleeve top coupler when the shaft sleeve is located in the hosel. Providing the hosel top coupler can comprises providing an arcuate socket surface substantially conforming to the spheroidal segment shape such that, when the sleeve insertion portion is located in the hosel bore, the arcuate joint surface of the sleeve top coupler and the arcuate socket surface of the hosel top coupler slidably seat against each other, thereby defining a pivot junction therebetween to enable displacement of the sleeve insertion portion within the hosel bore.

Other examples and embodiments are further disclosed herein. Such examples and embodiments may be found in the figures, in the claims, and/or in the present description.

Figure 2:
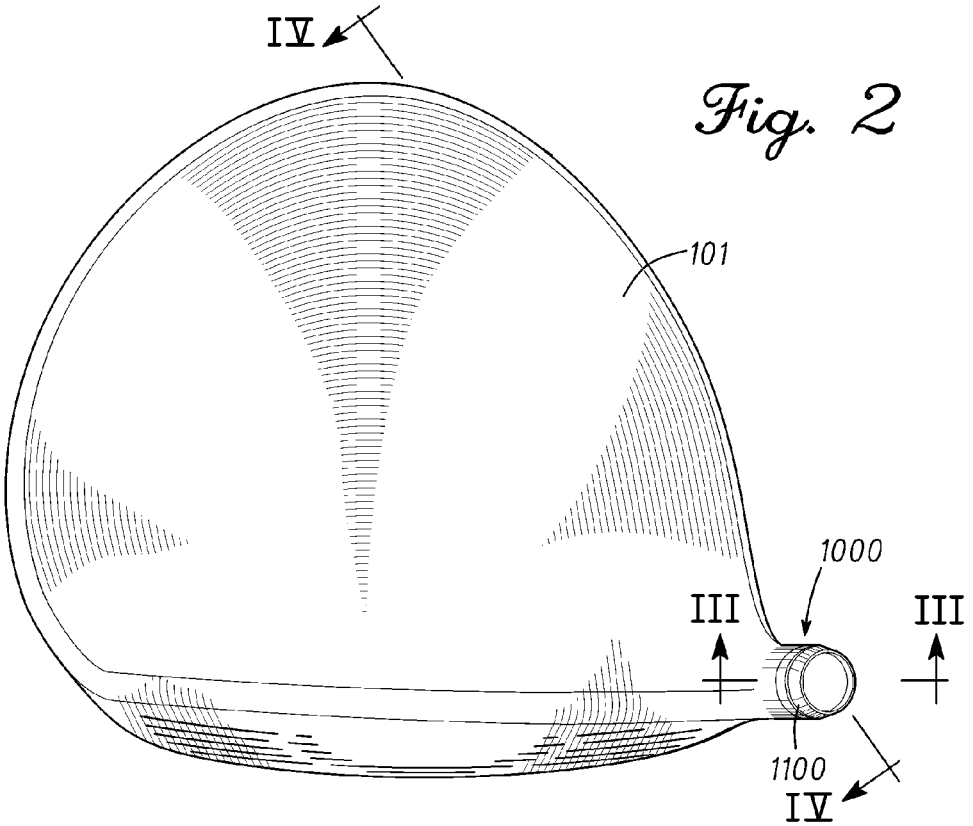
FIG. 2 illustrates a top perspective view of the golf club head with the golf coupling mechanism of FIG. 1.
Figure 3:
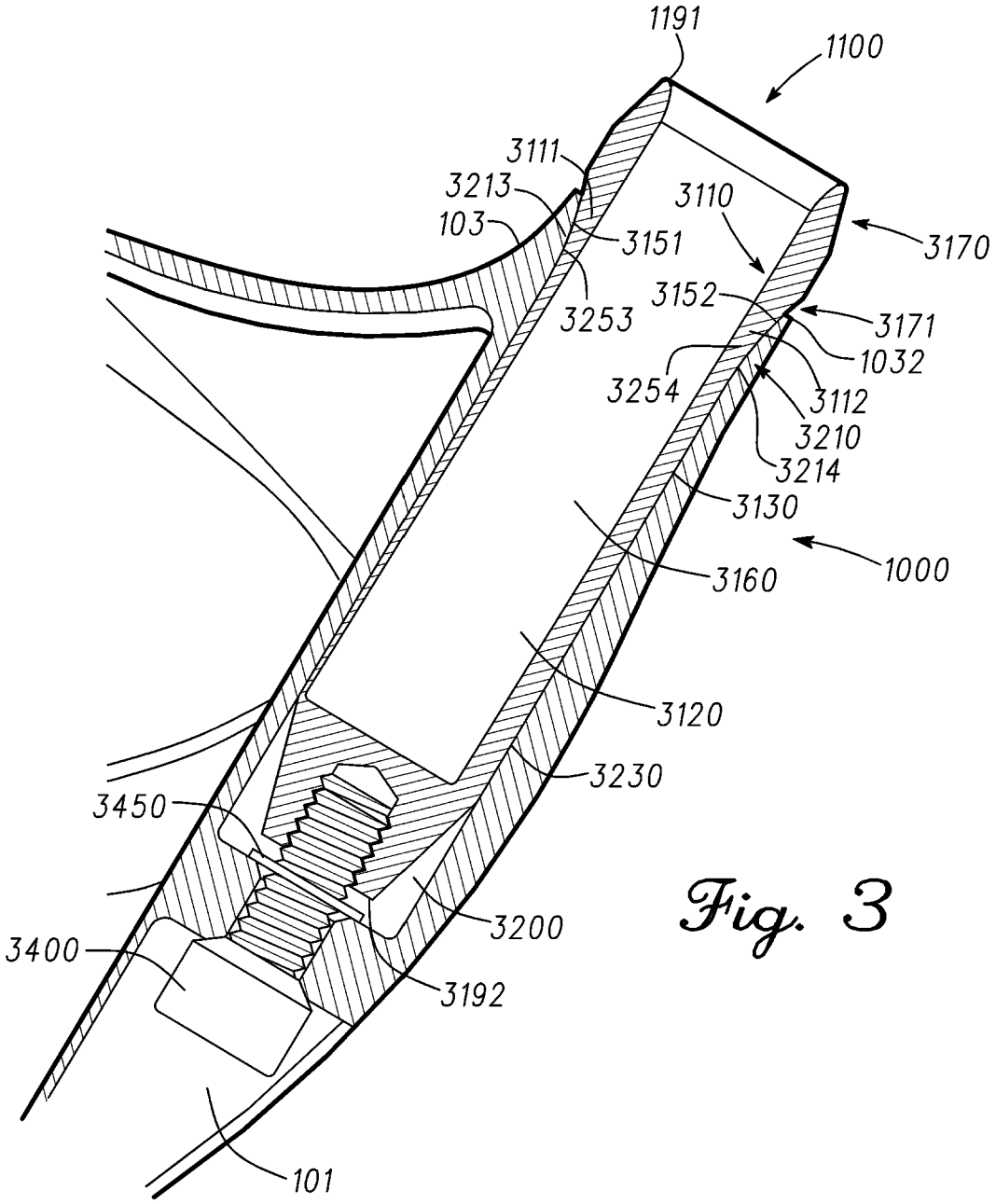
FIG. 3 illustrates a cross-sectional view of the golf club head along cross-sectional line III-III of FIG. 2, showing the golf coupling mechanism with a shaft sleeve inserted into a shaft receiver.
Figure 4:
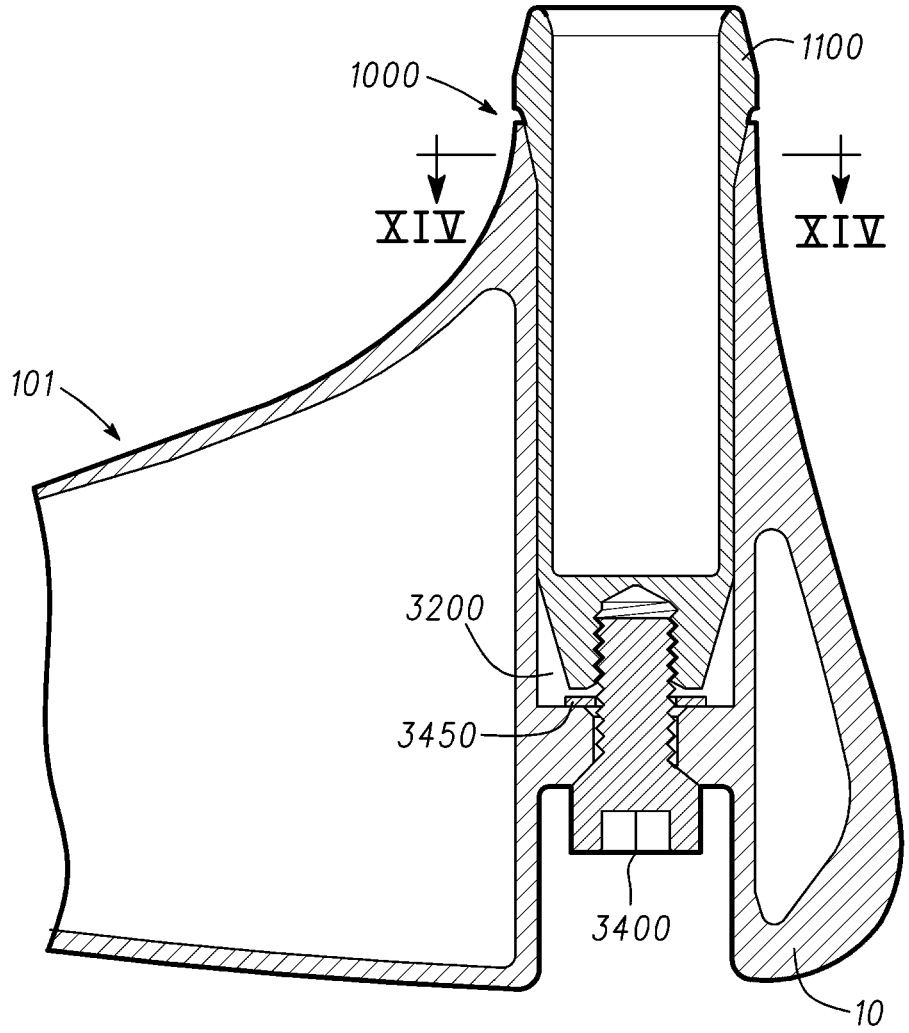
FIG. 4 illustrates a cross-sectional view of the golf club head and the golf coupling mechanism along cross-sectional line IV-IV of FIG. 2.

Turning to the drawings, FIG. 1 illustrates a front perspective view of golf club head 101 with golf coupling mechanism 1000 according to one example of the present disclosure. FIG. 2 illustrates a top perspective view of golf club head 101 with golf coupling mechanism 1000. FIG. 3 illustrates a cross-sectional view of golf club head 101 along line III-III of FIG. 2, showing golf coupling mechanism 1000 with shaft sleeve 1100 inserted into shaft receiver 3200. FIG. 4 illustrates a cross-sectional view of golf club head 101 and golf coupling mechanism 1000 along line IV-IV of FIG. 2.

In the present embodiment, golf coupling mechanism 1000 comprises shaft sleeve 1100 configured be coupled to an end of a golf club shaft, such as golf club shaft 102 (FIG. 1). FIG. 5 illustrates a side view of shaft sleeve 1100 decoupled from golf club head 101 (FIG. 1). FIG. 6 illustrates a cross sectional view of shaft sleeve 1100 along line VI-VI of FIG. 5. In the present example, shaft sleeve 1100 comprises shaft bore 3120 configured to receive the end of golf club shaft 102. Shaft sleeve 1100 also comprises sleeve axis 5150 extending along a longitudinal centerline of shaft sleeve 1100, from sleeve top end 1191 to sleeve bottom end 3192. Sleeve outer wall 3130 is a right angle cylinder such that at least portions of sleeve outer wall 3130 are substantially parallel to sleeve axis 5150 in the present example, and bound shaft bore 3120 therewithin. In other words, sleeve axis 5150 is the center of sleeve outer wall 3130 in this embodiment. In the present example, shaft bore 3120 extends coaxially to shaft bore axis 6150, and is angled with respect to sleeve axis 5150, thus being non-coaxial thereto. Shaft bore axis 6150 is angled at approximately 0.5 degrees from sleeve axis 5150 in the present example, but there can be examples where such angle can be of approximately 0.2 degrees to approximately 4 degrees relative to sleeve axis 5150. Accordingly, shaft bore 3210 and sleeve outer wall 3130 are not concentric in this embodiment. There can be other embodiments, however, where shaft bore axis 6150 can be substantially collinear with sleeve axis 5150, such that sleeve outer wall 3130 and shaft bore 3120 can be substantially concentric.

Figure 7:
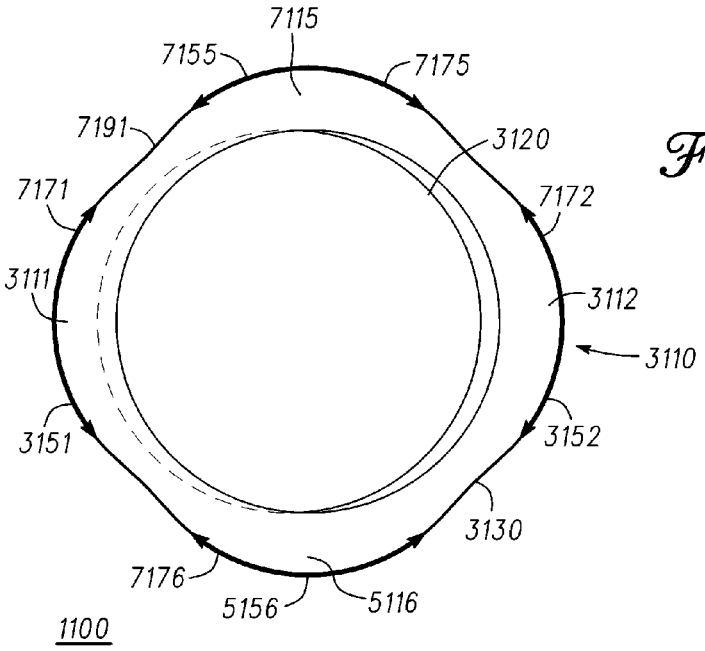
FIG. 7 illustrates a cross-section view of the shaft sleeve along cross-sectional line VII-VII of FIG. 5.

Shaft sleeve 1100 comprises sleeve coupler set 3110 with one or more couplers protruding from sleeve outer wall 3130. FIG. 7 illustrates a cross-section view of shaft sleeve 1100 along line VII-VII of FIG. 5 across sleeve coupler set 3110. FIGS. 3-7 illustrate different views of sleeve coupler set 3110 protruding from sleeve outer wall 3130. In the present example, sleeve coupler set 3110 comprises sleeve couplers 3111, 3112, 5116, and 7115 protruding from sleeve outer wall 3130, where sleeve coupler 3112 lies opposite sleeve coupler 3111 and sleeve coupler 7115 lies opposite sleeve coupler 5116 along perimeter 7191 of sleeve outer wall 3130. As can be seen from FIG. 7, sleeve coupler set 3110 forms alternating concave and convex surfaces about perimeter 7191 in the present embodiment.

The sleeve couplers of sleeve coupler set 3110 comprise arcuate surfaces configured to restrict rotation of shaft sleeve 1100 relative golf club head 101 when shaft sleeve 1100 is inserted and secured in shaft receiver 3200. For example, as seen in FIGS. 3, 5, and 7: (a) sleeve coupler 3111 comprises arcuate surface 3151 curved throughout the outer area of sleeve coupler 3111, (b) sleeve coupler 3112 comprises arcuate surface 3152 curved throughout the outer area of sleeve coupler 3112, (c) sleeve coupler 5116 comprises arcuate surface 5156 curved throughout the outer area of sleeve coupler 5116, and (d) sleeve coupler 7115 comprises arcuate surface 7155 curved throughout the outer area of sleeve coupler 7115.

Figure 8:
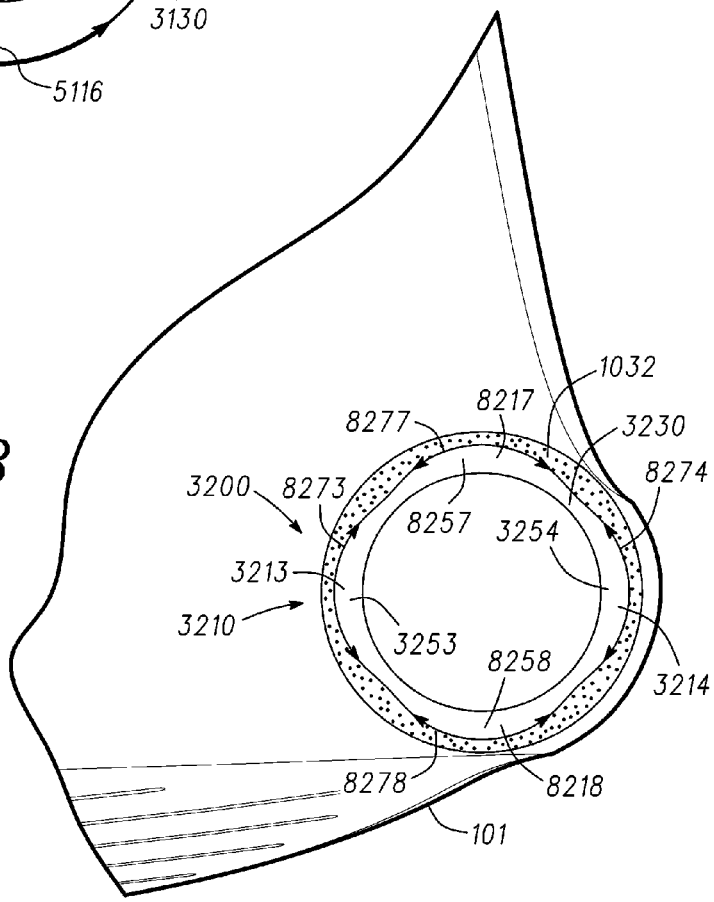
FIG. 8 illustrates a top view of the golf club head of FIG. 1, with the shaft sleeve removed therefrom, showing the shaft receiver from above.

Golf coupling mechanism 1000 also comprises shaft receiver 3200, configured to receive shaft sleeve 1100 as seen in FIGS. 3-4. FIG. 8 illustrates a top view of golf club head 101 with shaft sleeve 1100 removed therefrom, showing shaft receiver 3200 from above. FIG. 9 illustrates a cross-sectional side view of golf club head 101 with shaft sleeve 1100 removed therefrom and along line III-III of FIG. 2, showing a side cross section of shaft receiver 3200.

In the present example, shaft receiver 3200 is integral with hosel 1015 of club head 101, but there can be embodiments where shaft receiver 3200 can be distinct from hosel 1015 and coupled thereto via one or more fastening methods, such as via adhesives, via a screw thread mechanism, and/or via a bolt or rivet. In the same or other embodiments, the terms hosel and shaft receiver may be used interchangeably. There can also be embodiments where golf club head 101 may comprise a head bore into its crown or top portion, rather than hosel 1015. In such embodiments, the shaft receiver 3200 may also be part of, or coupled to, such head bore.

Shaft sleeve 1100 is configured to be inserted into shaft receiver 3200, and can be subdivided in several portions. For example, shaft sleeve 1100 comprises sleeve insertion portion 3160 bounded by sleeve outer wall 3130 and configured to be internal to shaft receiver 3200 when shaft sleeve 1100 is secured in shaft receiver 3200. In the present example, shaft sleeve 1100 also comprises sleeve top portion 3170, configured to remain external to shaft receiver 3200 when shaft sleeve 1100 is secured in shaft receiver 3200. There can be other examples, however, that are devoid of sleeve top portion 3170 and/or with a shaft sleeve similar to shaft sleeve 1100 but configured to be inserted in its entirety into shaft receiver 3200.

Shaft receiver 3200 comprises hosel outer wall 3240, with receiver inner wall 3230 configured to bound sleeve insertion portion 3160 and sleeve outer wall 3130 of shaft sleeve 1100 when inserted therein. Shaft receiver 3200 also comprises receiver coupler set 3210 configured to engage coupler set 3110 of shaft sleeve 1100 to restrict a rotation of shaft sleeve 1100 relative to shaft receiver 3200. In the present embodiment, as can be seen in FIG. 8, receiver coupler set 3210 comprises receiver couplers 3213, 3214, 8217, and 8218 indented into receiver inner wall 3230, with receiver coupler 3213 opposite receiver coupler 3214 and with receiver coupler 8218 opposite receiver coupler 8217.

The receiver couplers of receiver coupler set 3210 in shaft receiver 3200 comprise arcuate surfaces complementary with the arcuate surfaces of sleeve coupler set 3110 of shaft sleeve 1100. For example: (a) receiver coupler 3213 comprises arcuate surface 3253 curved throughout the inner area of receiver coupler 3213 (FIG. 8), where arcuate surface 3253 of receiver coupler 3213 is complementary with arcuate surface 3151 of sleeve coupler 3111 (FIG. 7), (b) receiver coupler 3214 comprises arcuate surface 3254 curved throughout the inner area of receiver coupler 3214 (FIG. 8), where arcuate surface 3254 of receiver coupler 3214 is complementary with arcuate surface 3152 of sleeve coupler 3112 (FIG. 7), (c) receiver coupler 8217 comprises arcuate surface 8257 curved throughout the inner area of receiver coupler 8217 (FIG. 8), where arcuate surface 8257 of receiver coupler 8217 is complementary with arcuate surface 7155 of sleeve coupler 7115 (FIG. 7), and (d) receiver coupler 8218 comprises arcuate surface 8258 curved throughout the inner area of receiver coupler 8218 (FIG. 8), where arcuate surface 8258 of receiver coupler 8218 is complementary with arcuate surface 5156 of sleeve coupler 5116 (FIG. 7).

In the present embodiment, the arcuate surfaces of sleeve coupler set 3110 and of receiver coupler set 3210 are curved throughout their respective sleeve couplers and receiver couplers. FIG. 10 illustrates a side view of a portion of shaft sleeve 1100 and sleeve coupler set 3110. FIG. 11 illustrates a side x-ray view of a portion of shaft receiver 3200 and receiver coupler set 3210. As seen in FIGS. 7 and 10, arcuate surface 5156 of sleeve coupler 5116 comprises horizontal radius of curvature 7176, arcuate surface 3151 of sleeve coupler 3111 comprises horizontal radius of curvature 7171, arcuate surface 3152 of sleeve coupler 3112 comprises horizontal radius of curvature 7172, and arcuate surface 7155 of sleeve coupler 7115 comprises horizontal radius of curvature 7175 in the present example. Also in the present example, the arcuate surfaces of sleeve coupler set 3110 comprise vertical taperings that decrease in thickness towards sleeve bottom end 3192 of shaft sleeve 1100 and towards sleeve axis 5150 (FIGS. 5-6). For example, as seen in FIG. 10, arcuate surface 5156 of sleeve coupler 5116 comprises vertical tapering 10186, arcuate surface 3151 of sleeve coupler 3111 comprises vertical tapering 10181, and arcuate surface 3152 of sleeve coupler 3112 comprises vertical tapering 10182. Although not shown in FIG. 10, arcuate surface 7155 of sleeve coupler 7115 also comprises a vertical tapering similar to vertical tapering 10186 of sleeve coupler 5116.

With respect to receiver coupler set 3210 of shaft receiver 3200, as seen in FIGS. 8 and 11, arcuate surface 8258 of receiver coupler 8218 comprises horizontal radius of curvature 8278 complementary with horizontal radius of curvature 7176 of sleeve coupler 5116 (FIGS. 7, 10), arcuate surface 3253 of receiver coupler 3213 comprises horizontal radius of curvature 8273 complementary with horizontal radius of curvature 7171 of sleeve coupler 3111 (FIG. 7), arcuate surface 3254 of receiver coupler 3214 comprises horizontal radius of curvature 8274 complementary with horizontal radius of curvature 7172 of sleeve coupler 3112 (FIG. 7), and arcuate surface 8257 of receiver coupler 8217 comprises horizontal radius of curvature 8277 complementary with horizontal radius of curvature 7175 of sleeve coupler 7115 (FIG. 7) in the present example.

Also in the present example, the arcuate surfaces of receiver coupler set 3210 comprise vertical taperings complementary to the vertical taperings of the arcuate surfaces of sleeve coupler set 3110. For example, as seen in FIG. 11, arcuate surface 8258 of receiver coupler 8218 comprises vertical tapering 11288 complementary with vertical tapering 10186 of sleeve coupler 5116 (FIG. 10), arcuate surface 3253 of receiver coupler 3213 comprises vertical tapering 11283 complementary with vertical tapering 10181 of sleeve coupler 3111 (FIG. 10), and arcuate surface 3254 of receiver coupler 3214 comprises vertical tapering 11284 complementary with vertical tapering 10182 of sleeve coupler 3112 (FIG. 10). Although not shown in FIG. 11, arcuate surface 8257 of receiver coupler 8217 also comprises a vertical tapering similar to vertical tapering 11288 of receiver coupler 8218 and complementary to the vertical tapering of sleeve coupler 7115.

In the present embodiment, the vertical taperings of the arcuate surfaces of sleeve coupler set 3110 are substantially linear, decreasing in a substantially straight line as can be seen in the profile view of vertical taperings 10181 and 10182 for sleeve couplers 3111 and 3112 in FIG. 10. Similarly, the vertical taperings of the arcuate surfaces of receiver coupler set 3210 are substantially linear, as can be seen in the profile view of vertical taperings 11283 and 11284 for receiver couplers 3213 and 3214 in FIG. 11. In the same or other examples, the substantially linear vertical taperings of the arcuate surfaces of sleeve coupler set 3110 and of receiver coupler set 3210 may be considered to comprise a large or infinite vertical radius of curvature yielding a substantially straight line.

Figure 12:
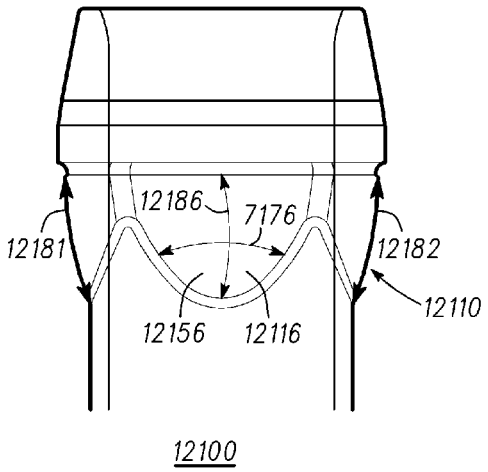
FIG. 12 illustrates a side view of a portion of a sleeve coupler set of a shaft sleeve similar to the shaft sleeve of FIGS. 1-7, and 10.
Figure 13:
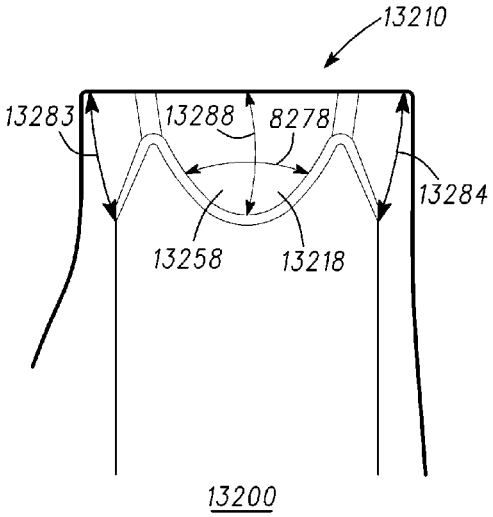
FIG. 13 illustrates a side x-ray view of a portion a receiver coupler set of a shaft receiver similar to the shaft receiver of FIGS. 1-4, 8-9, and 11.

There can be other embodiments, however, where the vertical taperings of the sleeve couplers and/or the receiver couplers need not be linear. FIG. 12 illustrates a side view of a portion of shaft sleeve 12100 with sleeve coupler set 12110. FIG. 13 illustrates a side x-ray cross-sectional view of shaft receiver 13200 with receiver coupler set 13210.

Shaft sleeve 12100 can be similar to shaft sleeve 1100 (FIGS. 1-7, 10), and shaft receiver 13200 can be similar to shaft receiver 3200 (FIGS. 3-4, 8, 10). Sleeve coupler set 12110 differs from sleeve coupler set 3110, however, by comprising vertical taperings that are not linear. For example, sleeve coupler set 12110 comprises vertical taperings 12186, 12181, and 12182 that are curved rather than linear, and can comprise respective vertical radii of curvature. Similarly, receiver coupler set 13210 comprises vertical taperings 13288, 13283, and 13284 that are curved rather than linear, and comprise respective vertical radii of curvature complementary with the radii of curvature of sleeve coupler set 12110. Accordingly, the sleeve couplers of sleeve coupler set 12110 and the receiver couplers of receiver coupler set 13120 are each curved horizontally and vertically throughout their respective surface areas. For example, any horizontal line tangential to any point of a total surface of sleeve coupler 12116 is non-tangential to any other point of the total surface of sleeve coupler 12116. In the same or other embodiments, the total surface of each sleeve coupler of sleeve coupler set 12110, and the total surface of each receiver coupler of receiver coupler set 13120 is each curved throughout and in all directions.

The different sleeve couplers and receiver couplers of the present disclosure may comprise respective curvatures within certain ranges. For example, with respect to FIGS. 7 and 10, horizontal radii of curvature 7171, 7172, 7175, and 7176 of sleeve coupler set 3110 are each of approximately 0.175 inches (4.45 millimeters (mm)), but there can be embodiments where they could range from approximately 0.1 inches (2.54 mm) to approximately 0.225 inches (5.715 mm). With respect to FIGS. 8 and 11, horizontal radii of curvature 8273, 8274, 8277, and 8278 of receiver coupler set 3210 can be complementarily the same or similar to horizontal radii of curvature 7171, 7172, 7175, and 7176 (FIGS. 7, 10), respectively. In addition, the horizontal radii of curvature for sleeve coupler set 12110 and for receiver coupler set 13210 in the embodiment of FIGS. 12-13 can also be similar to those described above with respect to the embodiment of FIGS. 1-11 for sleeve coupler set 3110 and/or receiver coupler set 3210.

As previously described, in the embodiment of FIGS. 1-11, the vertical taperings of sleeve coupler set 3110 (FIG. 10) and of receiver coupler set 3210 (FIG. 11) can comprise vertical radii of curvature approximating infinity, thereby yielding substantially straight lines. In the embodiment of FIGS. 12-13, the vertical taperings of sleeve coupler set 12110 (FIG. 12) and of receiver coupler set 13210 (FIG. 13) comprise more pronounced vertical radii of curvature. As an example the vertical radius of curvature for vertical tapering 12186 of sleeve coupler 12116 (FIG. 12) is of approximately 0.8 inches (20.32 mm), but there can be embodiments where it could range from approximately 0.4 inches (10.16 mm) to 2 inches (50.8 mm). The vertical radii of curvature for other similar portions of sleeve coupler set 12110 can also be in the same range described for vertical tapering 12186. In addition, the vertical radii of curvature for receiver coupler set 13210 (FIG. 13) can be complementarily the same or similar to the vertical radii of curvature described for sleeve coupler set 12110 (FIG. 12).

In some examples, the arcuate surfaces of the sleeve couplers and/or of the receiver couplers may comprise portions of geometric structures. For instance, the arcuate surface of sleeve coupler 12116 (FIG. 12) can comprise a quadric surface, and the arcuate surface of receiver coupler 13218 (FIG. 13) can comprise a quadric surface complementary to the arcuate surface of sleeve coupler 12116. In such examples, the quadric surface of sleeve coupler 12116 and of receiver coupler 13218 can comprise, for example, a portion of a paraboloid surface or a portion of a hyperboloid surface. There can also be examples with sleeve couplers and receiver couplers whose quadric arcuate surfaces can comprise a portion of a degenerate quadric surface, such as a portion of a conical surface. Such examples can be similar to those of FIGS. 10-11 with respect to sleeve coupler set 3110 and receiver coupler set 3200.

In the embodiments of FIGS. 10-11 and of FIGS. 12-13, the arcuate surfaces of the sleeve couplers of sleeve coupler set 3110 (FIG. 10) and/or 12110 (FIG. 12), and the arcuate surfaces of the receiver couplers of receiver coupler set 3210 (FIG. 11) and/or 13210 (FIG. 13), can be configured to be devoid of any inflection point, such as to be continuously curved. In the same or other embodiments, such arcuate surfaces can also be configured to be edgeless (except for their respective perimeter). For example, the total surface area of sleeve coupler 5116 (FIG. 10) is edgeless with respect to any portion of its total surface area within its perimeter. In addition, the total surface area of receiver coupler 8218 (FIG. 11) also is edgeless with respect to any portion of its total surface area within its perimeter. Similar edgeless attributes are also shared by sleeve coupler 12110 (FIG. 12) and receiver coupler 13218 (FIG. 13). The characteristics described above can permit the contact area to be maximized when sleeve couplers seat against receiver couplers to restrict rotation of their shaft sleeves relative to their respective shaft receivers.

As can be seen in FIGS. 3-7 and 10, sleeve coupler set 3110 protrudes from a top section of sleeve outer wall 3130. Similarly, as can be seen in FIGS. 3-4, 8-9, and 11, receiver coupler set 3210 is indented into a top section of receiver inner wall 3230. There can be other embodiments, however, where sleeve coupler set 3110 and receiver coupler set 3210 may be located elsewhere. For instance, sleeve coupler set 3110 and receiver coupler set 3210 may be located at or towards bottom sections or mid sections of shaft sleeve 1100 and shaft receiver 3200, respectively. In the same or other embodiments, the shape of sleeve coupler set 3110 and receiver coupler set 3210 could be reversed such that sleeve coupler set 3110 is recessed into sleeve outer wall 3130 and receiver coupler set 3210 protrudes from receiver inner wall 3230. The apparatus, methods, and articles of manufacture described herein are not limited in this regard.

As can be seen in the cross section presented in FIG. 3, golf coupling mechanism 1000 also comprises securing fastener 3400 configured to secure shaft sleeve 1100 to shaft receiver 3200. In the present example, securing fastener 3400 comprises a bolt configured to couple, via a passageway at a bottom of shaft receiver 3200, with sleeve bottom end 3192 of shaft sleeve 1100. Securing fastener 3400 is configured to couple with sleeve bottom end 3192 via a screw thread mechanism. As the screw thread mechanism is tightened, securing fastener 3400 is configured to pull shaft sleeve 1100 towards the bottom end of shaft receiver 3200, thereby causing the arcuate surfaces of sleeve coupler set 3110 to seat against the arcuate surfaces of receiver coupler set 3210.

In examples such as the present one, the combined total masses of the body of golf club head 101, shaft sleeve 1100, and securing fastener 3400 may be referred to as an assembled club head mass, while the mass of the body of golf club head 101, without shaft sleeve 1100 and securing fastener 3400, may be referred to as a disassembled club head mass.

In the present embodiment, securing fastener 3400 comprises retainer element 3450 coupled thereto to restrict or at least inhibit securing fastener 3400 from being fully removed from shaft receiver 3200 when decoupled from shaft sleeve 1100. Retainer element 3450 comprises a washer located within shaft receiver 3200 and coupled around the threads of securing fastener 3400. Retainer element 3450 can be configured to flexibly engage the threads of securing fastener 3400 in the present embodiment, such as to permit positioning thereof along the threads of securing fastener 3400 by ramming securing fastener 3400 through retainer element 3450, and such as to remain substantially in place once positioned along the threads of securing fastener 3400. Retainer element 3450 can thus retain an end of securing fastener 3400 within shaft receiver 3200 after shaft sleeve 1100 is removed therefrom, and can permit insertion of the end of securing fastener 3400 into sleeve bottom end 3192. In some examples, retainer element 3450 can comprise a material such as a nylon material or other plastic material more flexible than the material of securing fastener 3400.

In other examples, the bore through which securing fastener 3400 enters shaft receiver 3200 may comprise threading corresponding to that of securing fastener 3400, where such threading can thereby serve as the retainer element. IN these other examples, retainer element 3450 can be omitted.

Sleeve coupler set 3110 and receiver coupler set 3210 are configured such that at least a majority of their respective arcuate surfaces seat against each other when shaft sleeve 1110 is secured in shaft receiver 3200 by securing fastener 3400. For example, in the embodiment of FIGS. 10-11, when seated against each other, at least a majority of a total surface of sleeve coupler 5116 and a majority a total surface of receiver coupler 8218 contact each other and restrict rotation of shaft sleeve 1100 relative to shaft receiver 3200. As another example, in the embodiment of FIGS. 11-12, when seated against each other, a majority of a total surface of sleeve coupler 12116 and a majority of a total surface of receiver coupler 13218 also contact each other to restrict rotation. In the same or other examples, the contact area defined by the interface between an individual sleeve coupler of sleeve coupler set 3110 (FIG. 10) or 12110 (FIG. 12) and an individual receiver coupler of receiver coupler set 3210 (FIG. 11) or 13210 (FIG. 13) may be of approximately 51% to approximately 95% of a total surface of the individual receiver coupler or the individual sleeve coupler. Such contact area may be even greater in some embodiments, such as to substantially approach or equal the total surface of the individual receiver coupler and/or of the individual sleeve coupler. There can also be examples where, when the arcuate surfaces of the sleeve couplers of sleeve coupler set 3110 (FIG. 10) or 12110 (FIG. 12) seat against the arcuate surfaces of the receiver couplers of receiver coupler set 3200 (FIG. 11) or 13210 (FIG. 13), normal forces are exerted against each other across the respective contact areas.

In the present example, when securing fastener 3400 secures shaft sleeve 1100 in shaft receiver 3200, sleeve top portion 3170 remains external to shaft receiver 3200, with bottom end 3171 of sleeve top portion 3170 spaced away from a top end of shaft receiver 3200 by the seating of sleeve coupler set 3110 against receiver coupler set 3210. Such built-in spacing eases manufacturing tolerances, ensuring that sleeve coupler set 3110 can properly seat against receiver coupler set 3210.

In the same or other examples, a portion of one or more of the sleeve couplers of sleeve coupler set 3110 may protrude past the top end of shaft receiver 3200. There can also be examples where one or more of the sleeve couplers of sleeve coupler set 3110 may extend past the bottom end of one or more of the receiver couplers of receiver coupler set 3210. In other examples, one or more of the receiver couplers of receiver coupler set may extend past the bottom end of one or more of the sleeve couplers of sleeve coupler set 3110. Some of the features described above may be designed into golf coupling mechanism 1000 to ease the required manufacturing tolerances while still permitting proper seating of sleeve coupler set 3110 against receiver coupler set 3210.

Figure 14:
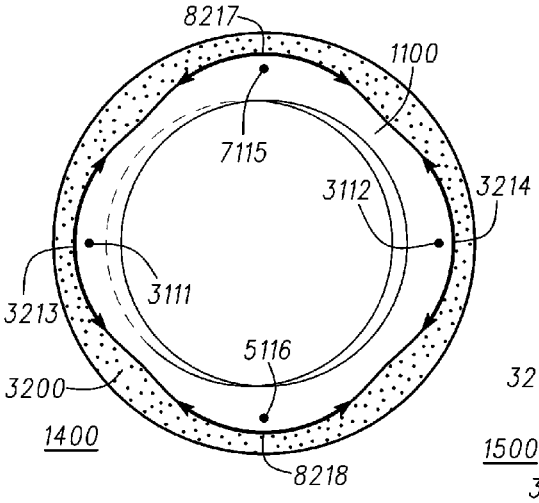
FIG. 14 illustrates a top cross-sectional view of the golf coupling mechanism in a first configuration, with respect to the viewpoint of cross-sectional line XIV-XIV of FIG. 4.

FIG. 14 illustrates a top cross-sectional view of golf coupling mechanism 1000 in configuration 1400, with respect to the viewpoint of line XIV-XIV of FIG. 4. Golf coupling mechanism 1000 is shown in FIGS. 3-4 and 14 in configuration 1400, where sleeve couplers 3111, 7115, 3112, and 5116

(FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1400 in FIG. 14 can comprise a first lie angle and a first loft angle between shaft bore axis 6150 (FIG. 6) and shaft receiver 3200 (FIGS. 3-4, 8-9) and/or between shaft 102 (FIG. 1) and golf club head 101 (FIG. 1).

Figure 15:
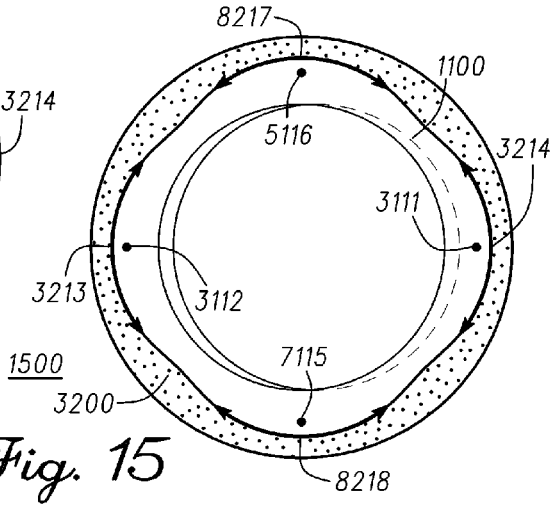
FIG. 15 illustrates a top cross-sectional view of the golf coupling mechanism in a second configuration, with respect to the viewpoint of cross-sectional line XIV-XIV of FIG. 4.

FIG. 15 illustrates a top cross-sectional view of golf coupling mechanism 1000 in configuration 1500, with respect to the viewpoint of line XIV-XIV of FIG. 4. In configuration 1500, sleeve couplers 3112, 5116, 3111, and 7115 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1500 in FIG. 15 can comprise a second lie angle and a second loft angle between shaft bore axis 6150 (FIG. 6) and shaft receiver 3200 (FIGS. 3-4, 8-9) and/or between shaft 102 (FIG. 1) and golf club head 101 (FIG. 1).

FIG. 16 illustrates a top cross-sectional view of golf coupling mechanism 1000 in configuration 1600, with respect to the viewpoint of line XIV-XIV of FIG. 4. In configuration 1600, sleeve couplers 7115, 3112, 5116, and 3111 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1600 in FIG. 16 will comprise a third lie angle and a third loft angle between shaft bore axis 6150 (FIG. 6) and shaft receiver 3200 (FIGS. 3-4, 8-9) and/or between shaft 102 (FIG. 1) and golf club head 101 (FIG. 1).

FIG. 17 illustrates a top cross-sectional view of golf coupling mechanism 1000 in configuration 1700, with respect to the viewpoint of line XIV-XIV of FIG. 4. In configuration 1700, sleeve couplers 5116, 3111, 7115, and 3112 (FIG. 7) of sleeve coupler set 3110 are respectively coupled to receiver couplers 3213, 8217, 3214, and 8218 (FIG. 8) of receiver coupler set 3210. Because shaft bore axis 6150 (FIG. 6) is non-coaxial with sleeve axis 5150 of shaft sleeve 1100 as described above, configuration 1700 in FIG. 17 will comprise a fourth lie angle and a fourth loft angle between shaft bore axis 6150 (FIG. 6) and shaft receiver 3200 (FIGS. 3-4, 8-9) and/or between shaft 102 (FIG. 1) and golf club head 101 (FIG. 1).

Depending on the angle of shaft bore axis 6150 with respect to sleeve axis 5150 and sleeve coupler set 3110, different lie and loft angle alignments may be attained via the configurations shown in FIGS. 14-17. For example, in the present embodiment, as can be seen in FIG. 6, the angle between shaft bore axis 6150 and sleeve axis 5150 causes the bottom of shaft bore 3120 to point towards sleeve coupler 3111, such that shaft 102 (FIG. 1) will lean towards sleeve coupler 3112 when inserted into shaft sleeve 1100.

Accordingly, in configuration 1400 (FIG. 14), the first lie angle may comprise a lower lie angle, and the first loft angle may comprise a neutral or middle loft angle. As an example, the first lie angle can be set to tilt the grip end of shaft 102 towards the heel of golf club head 101 (FIG. 1) by approximately 0.2 degrees to approximately 4 degrees, thereby decreasing the lie angle of the golf club in configuration 1400. The first loft angle, being neutral in the present example, does not affect the tilt of shaft 102 in configuration 1400.

In configuration 1500 (FIG. 15), the second lie angle may comprise a higher lie angle, and the second loft angle may comprise a neutral or middle loft angle, which may be similar or equal to the first loft angle of configuration 1400 (FIG. 14). As an example, second lie angle can be set to tilt the grip end of shaft 102 towards the toe of golf club head 101 (FIG. 1) by approximately 0.2 degrees to approximately 4 degrees, thereby increasing the lie angle of the golf club in configuration 1500. The second loft angle, being neutral in the present example, does not affect the tilt of shaft 102 in configuration 1500.

In configuration 1600 (FIG. 16), the third loft angle may comprise a lower loft angle, and the third lie angle may comprise a neutral or middle lie angle. As an example, the third loft angle can be set to tilt the grip end of shaft 102 towards the rear of golf club head 101 (FIG. 1) by approximately 0.2 degrees to approximately 4 degrees, thereby decreasing the loft angle of the golf club in configuration 1600. The third lie angle, being neutral in the present example, does not affect the tilt of shaft 102 in configuration 1600.

In configuration 1700 (FIG. 17), the fourth loft angle may comprise a higher loft angle, and the fourth lie angle may comprise a neutral or middle lie angle, which may be similar or equal to the third lie angle of configuration 1600 (FIG. 16). As an example, the fourth loft angle can be set to tilt the grip end of shaft 102 towards the front or strike face of golf club head 101 (FIG. 1) by approximately 0.2 degrees to approximately 4 degrees, thereby increasing the loft angle of the golf club in configuration 1700. The fourth lie angle, being neutral in the present example, does not affect the tilt of shaft 102 in configuration 1700.

Other lie and loft angle relationships may be configured in other embodiments by altering the angle and/or orientation of shaft bore axis 6150 (FIG. 6) with respect to sleeve axis 5150 (FIG. 6) of shaft sleeve 1100. Furthermore, as seen from FIGS. 14-17, sleeve couplers 3111, 3112, 5116, and 7115 are symmetric with each other, and receiver couplers 3213, 3214, 8217, and 8218 are also symmetric with each other. In a different embodiment, only opposite ones of the sleeve couplers and the receiver couplers may be symmetric with each other such that only two (and not four) different lie and loft angle combinations are permitted.

The different features described above for the golf coupler mechanisms of FIGS. 1-17 can also impart several performance benefits to the golf clubs on which they are used, when compared to other golf club heads with adjustable shaft coupling mechanisms. For example, because of the small number of parts required, and/or because receiver coupler set 3210 is located only towards the top end of shaft receiver 3200 (FIG. 3), hosel diameter 1031 of hosel 1015 (FIG. 1) can be maintained to a minimum and/or relatively unchanged from a hosel diameter of a corresponding regular golf club head. In some examples, as can be seen in FIG. 8, hosel diameter 1031 can be of less than approximately 20 mm, such as of approximately 0.55 inches (approximately 14 mm), or such as of approximately 0.53 inches (approximately 13.46 mm) at receiver top end 1032. In addition, top wall thickness 9250 (FIGS. 8-9) of shaft receiver 3200 can be minimized as shown at receiver top end 1032 of shaft receiver 3200. For instance, top wall thickness 9250 can be of approximately 0.035 inches (approximately 0.9 mm) or less, such as of approximately 0.024 inches (approximately 0.61 mm).

As can be seen in FIG. 8, top wall thickness 9250 varies in thickness along receiver top end 1032 in the present embodiment, and comprises at least one hosel top wall narrow section 8252 and at least one hosel top wall thick section 8251 at receiver top end 1032. Hosel top wall thick section 8251 can have a thickness less than or equal to approximately 2.3 mm at receiver top end 1032, when measured radially relative to a centerpoint of hosel diameter 1031. Hosel top wall narrow section 8252 can have a thickness less than or equal to approximately 0.9 mm at receiver top end 1032, when measured radially relative to the centerpoint of hosel diameter 1031. In the present example, when measured radially relative to the centerpoint of hosel diameter 1031, hosel top wall thick section 8251 can be less than or equal to approximately 1.27 mm, and hosel top wall narrow section 8252 can be less than or equal to 0.64 mm.

Figure 19:
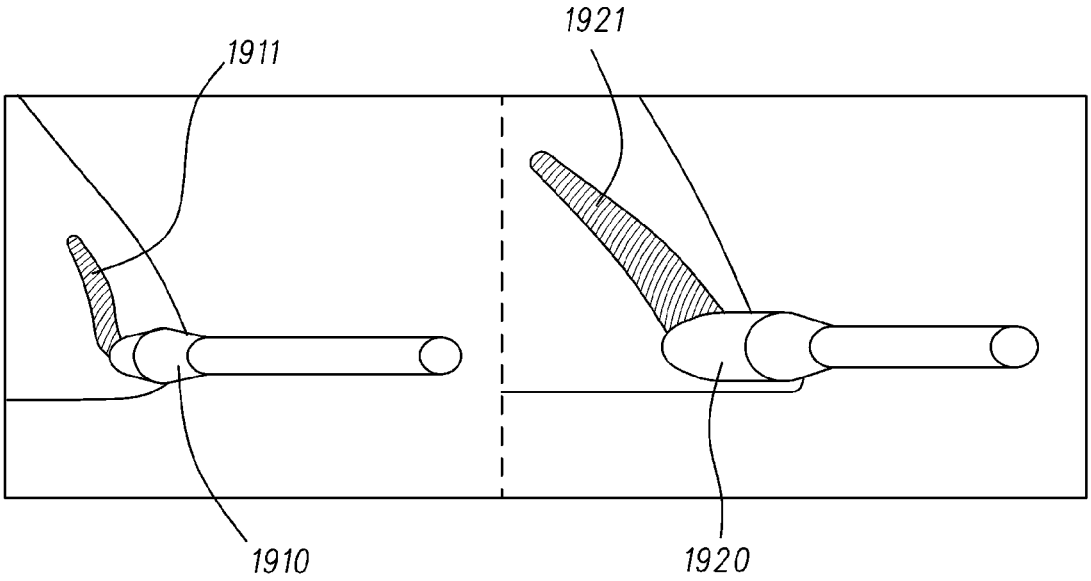
FIG. 19 illustrates a comparison of stagnant drag wake areas for respective hosels of different golf club heads.
Figure 20:
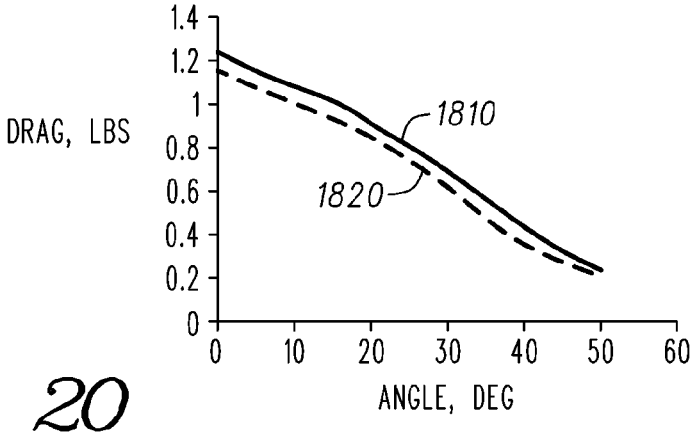
FIG. 20 illustrates a chart of drag as a function of open face angle with respect to the hosel diameters the golf club heads of FIG. 19.

Because hosel diameter 1031 can be minimized as described above, the aerodynamic characteristics of golf club head 101 can be improved as a result of the reduced aerodynamic drag from hosel 1015. FIG. 19 illustrates a comparison of stagnant drag wake areas 1911 and 1921 for respective hosels of golf club heads 1910 and 1920, where golf club head 1910 comprises a hosel diameter of approximately 0.5 inches, and where golf club head 1920 comprises a larger hosel diameter of approximately 0.62 inches. In some examples, golf club head 1910 can be similar to golf club head 101 (FIGS. 1-4, 8-9). As seen in FIG. 19, the larger hosel diameter of club head 1920 creates larger stagnant drag wake area 1921 downstream of its hosel, leading to higher values of aerodynamic drag when compared to the smaller stagnant drag wake area 1911 of club head 1910. FIG. 20 illustrates a chart of drag as a function of open face angle with respect to the hosel diameters golf club heads 1910 and 1920. In some examples, club head 1910 can also comprise a golf club shaft of reduced shaft thickness, such as a shaft thickness of approximately 0.335 inches (approximately 8.5 mm). In the same or other examples, for open-faced orientations of up to 50 degrees, such difference in hosel diameter can amount for up to approximately 0.1 pounds less drag resistance for golf club head 1910 when compared to the larger drag of golf club head 1920. In the same or other examples, the drag of golf club head 1910 can range from approximately 1.2 pounds at an approximately square orientation, to approximately 0.2 pounds at an open-faced orientation of approximately 50 degrees.

In the same or other embodiments, the mass and/or mass ratio of the golf coupler mechanisms of FIGS. 1-17 can be minimized with respect to their respective golf club heads when compared to other golf club heads with adjustable shaft coupling mechanisms. For instance, in examples where golf club head 101 (FIGS. 1-4, 8-9) comprises a driver-type golf club head, the different elements of club head 101 can comprise mass characteristics similar to those summarized below in Table 1.

TABLE 1

Sample Mass Characteristics for Driver-Type Golf Club Head

| | Exemplary Driver Head | Ranges for Driver Heads |
|---|---|---|
| Mass of Club Head 101 (Disassembled) | ≤192 grams (approx.) | 185-205 grams (approx.) |
| Mass of Sleeve 1100 | ≤5.2 grams (approx.) | ≤6 grams (approx.) |
| Mass of Sleeve 1100 + Securing Fastener 3400 | ≤6.8 grams (approx.) | ≤7.5 grams (approx.) |
| Total Assembled Club Head Mass | ≤198.8 grams (approx.) | 188-213 grams (approx.) |

In such examples, the mass ratios for the golf coupler mechanism 1000 relative to assembled club head 101 can be very low, as summarized below in Table 2.

TABLE 2

Sample Mass Ratios for Driver-Type Golf Club Head

| | Exemplary Driver Head | Ranges for Driver Heads |
|---|---|---|
| $\frac{\text{Mass of Sleeve}}{\text{Mass of Disassembled Club Head}}$ | ≤2.7% (approx.) | ≤3% (approx.) |
| $\frac{\text{Mass of Sleeve}}{\text{Mass of Assembled Club Head}}$ | ≤2.6% (approx.) | ≤3% (approx.) |
| $\frac{\text{Mass of (Sleeve + Securing Fastener)}}{\text{Mass of Disassembled Club Head}}$ | ≤3.5% (approx.) | ≤4% (approx.) |
| $\frac{\text{Mass of (Sleeve + Securing Fastener)}}{\text{Mass of Assembled Club Head}}$ | ≤3.4% (approx.) | ≤4% (approx.) |

In other examples, such as where golf club head 101 (FIGS. 1-4, 8-9) comprises a fairway-wood-type golf club head, the different elements of club head 101 can comprise mass characteristics similar to those summarized below in Table 3.

TABLE 3

Sample Mass Characteristics for Fairway-Wood-Type Golf Club Head

| | Exemplary 3-FW Head | Exemplary 5-FW Head | Exemplary 7-FW Head | Ranges for FW Heads |
|---|---|---|---|---|
| Mass of Club Head 101 (Disassembled) | ≤205 grams (approx.) | ≤209 grams (approx) | ≤213 grams (approx.) | 200-225 grams (approx.) |
| Mass of Sleeve 1100 | ≤5.2 grams (approx.) | ≤5.2 grams (approx.) | ≤5.2 grams (approx.) | ≤6 grams (approx.) |
| Mass of Sleeve 1100 + Securing Fastener 3400 | ≤6.8 grams (approx.) | ≤6.8 grams (approx.) | ≤6.8 grams (approx.) | ≤7.5 grams (approx.) |
| Total Assembled Club Head Mass | ≤211.8 (approx.) | ≤215.8 (approx.) | ≤219.8 (approx.) | 203-233 grams (approx.) |

In such examples, the mass ratios for the golf coupler mechanism 1000 relative to assembled club head 101 can be very low, as summarized below in Table 4.

TABLE 4

Sample Mass Ratios for Fairway-Wood-Type Golf Club Head

| | Exemplary 3-FW Head | Exemplary 5-FW Head | Exemplary 7-FW Head | Ranges for FW Heads |
|---|---|---|---|---|
| Mass of Sleeve / Mass of Disassembled Club Head | ≤2.54% (approx.) | ≤2.48% (approx.) | ≤2.44% (approx.) | ≤2.8% (approx.) |
| Mass of Sleeve / Mass of Assembled Club Head | ≤2.46% (approx.) | ≤2.41% (approx.) | ≤2.36% (approx.) | ≤2.8% (approx.) |
| Mass of (Sleeve + Securing Fastener) / Mass of Disassembled Club Head | ≤3.32% (approx.) | ≤3.25% (approx.) | ≤3.19% (approx.) | ≤3.5% (approx.) |
| Mass of (Sleeve + Securing Fastener) / Mass of Assembled Club Head | ≤3.21% (approx.) | ≤3.16% (approx.) | ≤3.10% (approx.) | ≤3.5% (approx.) |

There can be examples where the mass, dimension, and/or location characteristics described above can provide benefits and/or flexibility with respect to the mass distribution and/or location of the center of gravity (CG) for the golf club head. For example, shaft sleeve center of gravity 1150 (FIG. 1) of shaft sleeve 1100 can be configured to be located at shaft sleeve CG vertical distance 1159 (FIG. 1).

In some examples, such as in embodiments where club head 101 (FIGS. 1-4, 8-9) comprises a driver-type golf club head, shaft sleeve center of gravity 1150 (FIG. 1) of shaft sleeve 1100 can be configured to be located at shaft sleeve CG vertical distance 1159 can be of less than approximately 50 mm above the exterior sole bottom end 10141 of sole 1014 of driver-type club head 101. In the same or other examples, shaft sleeve CG vertical distance 1159 can be less than approximately 46.2 mm above exterior sole bottom end 10141. In the same or other examples, shaft sleeve CG vertical distance 1159 can be less than approximately 43.7 mm above the exterior sole bottom end 10141. Shaft sleeve center of gravity 1150 of shaft sleeve 1100 also can be configured to be located at shaft sleeve CG vertical distance 1059 (FIG. 1) of less than approximately 0.59 inches (approximately 15 mm) above assembled club head center of gravity 1050 (FIG. 1) of driver-type assembled golf club head 101 in some embodiments. In the same or other embodiments, shaft sleeve CG vertical distance 1159 can be at least approximately 7.6 mm greater than assembled club head CG vertical distance 1058 of driver-type club head 101.

In other examples, such as in embodiments where club head 101 (FIGS. 1-4, 8-9) comprises a fairway-wood-type golf club head, shaft sleeve center of gravity 1150 (FIG. 1) of shaft sleeve 1100 can be configured to be located at shaft sleeve CG vertical distance 1159 of less than approximately 35.6 mm above exterior sole bottom end of sole 1014 of fairway-wood-type club head 101. In the same or other examples, shaft sleeve CG vertical distance 1159 can be less than approximately 1.35 inches (approximately 34.3 mm) above exterior sole bottom end 10141 of sole 1014 of fairway-wood-type club head 101. Shaft sleeve center of gravity 1150 of shaft sleeve 1100 also can be configured to be located at shaft sleeve CG vertical distance 1059 (FIG. 1) of less than approximately 19 mm above assembled club head center of gravity 1050 (FIG. 1) of fairway-wood-type assembled golf club head 101 in some embodiments. In the same or other embodiments, shaft sleeve CG vertical distance 1159 can be at least approximately 16.5 mm greater than assembled club head CG vertical distance 1058 of fairway-wood-type club head 101.

In the present example, as seen in FIG. 1, hosel 1015 comprises hosel axis 1016 extending along a longitudinal centerline of hosel 1015. Hosel axis 1016 defines hosel lie angle 1018 relative to bottom horizontal axis 1019, where bottom horizontal axis 1019 is horizontally tangent to sole bottom end 10141. In some embodiments, hosel lie angle 1018 can be of, for example, approximately 58 degrees. In the present embodiment, shaft sleeve CG vertical distance 1159 and assembled club head CG vertical distance 1058 extend vertically from bottom horizontal axis 1019.

Club head 101 also comprises crown height vertical distance 1018 extending vertically to the top end of crown 1017 relative to sole bottom end 10141. In some embodiments, such as where club head 101 comprises a driver-type golf club head, crown height vertical distance 1018 can be of at least approximately 59.7 mm relative to sole bottom end 10141. In the same or other embodiments, assembled club head CG vertical distance can be less than approximately 33 mm relative to sole bottom end 10141.

There can also be examples, such as seen in FIG. 1, where receiver top end 1032 is at the top of hosel 1015 and is configured to remain below the top end of crown 1017 of golf club head 101. Hosel 1015 can be devoid of a cylindrical external top section in the same or other embodiments, where crown 1017 can transition to the substantially circular external perimeter at receiver top end 1032 of hosel 1015 without defining an cylindrical external shape for hosel 1015. Such features can permit location of the center of gravity of shaft sleeve 1100 closer to the center of gravity of assembled golf club head 101.

Backtracking though the figures, FIG. 18 illustrates a flowchart for a method 18000, which can be used to provide, form, and/or manufacture a golf coupler mechanism in accordance with the present disclosure. In some examples, the golf coupler mechanism can be similar to golf coupler mechanism 1000 of FIGS. 1-11 and 14-16, or the golf coupler mechanism of FIGS. 12-13.

Method 18000 comprises block 18100 for providing a shaft sleeve to couple with an end of a golf club shaft and comprising a sleeve arcuate coupler set. In some examples, the shaft sleeve can be similar to shaft sleeve 1100 (FIGS. 1-7, 10, 14-16) and/or to shaft sleeve 12100 (FIG. 12), and the golf club shaft can be similar to golf club shaft 102 (FIGS. 1, 5). In the same or other examples, the sleeve arcuate coupler set can be similar to sleeve coupler set 3110 (FIGS. 3-7, 10, 14-17) and/or to sleeve coupler set 12110 (FIG. 12).

Block 18200 of method 18000 comprises providing a shaft receiver of a golf club head, comprising a receiver arcuate coupler set configured to couple with the sleeve arcuate coupler set of the shaft sleeve. In some examples, the shaft receiver can be similar to shaft receiver 3200 (FIGS. 3-4, 8-9, 11, 14-17) and/or to shaft receiver 13200 (FIG. 13). The receiver arcuate coupler set can be similar to receiver coupler set 3210 (FIGS. 3-4, 8-9, 11, 14-17) and/or to receiver coupler set 13210 (FIG. 13).

Block 18300 of method 18000 comprises providing a securing fastener configured to secure the shaft sleeve to the shaft receiver. In some examples, the securing fastener can be similar to securing fastener 3400 (FIGS. 3-4). The securing fastener can be configured to pull the shaft sleeve towards the shaft receiver to seat the sleeve arcuate coupler set against the receiver arcuate coupler set.

In some examples, one or more of the different blocks of method 18000 can be combined into a single block or performed simultaneously, and/or the sequence of such blocks can be changed. For example, in some embodiments, blocks 18200 and 18300 may be combined if desired. In the same or other examples, some of the blocks of method 18000 can be subdivided into several sub-blocks. As an example, block 18100 may comprise a sub-block for forming horizontal radii of curvature for the arcuate surfaces of the sleeve couplers of the sleeve arcuate coupler set, and a sub-block for forming vertical taperings for the arcuate surfaces of the sleeve couplers of the sleeve arcuate coupler set. There can also be examples where method 18000 can comprise further or different blocks. As an example, method 18000 may comprise another block for providing the golf club head for the shaft receiver of block 18200, and/or another block for providing the shaft for the shaft sleeve of block 18100. In addition, there may be examples where method 18000 can comprise only part of the steps described above. For instance, block 18300 may be optional in some implementations. Other variations can be implemented for method 18000 without departing from the scope of the present disclosure.

Figure 21:
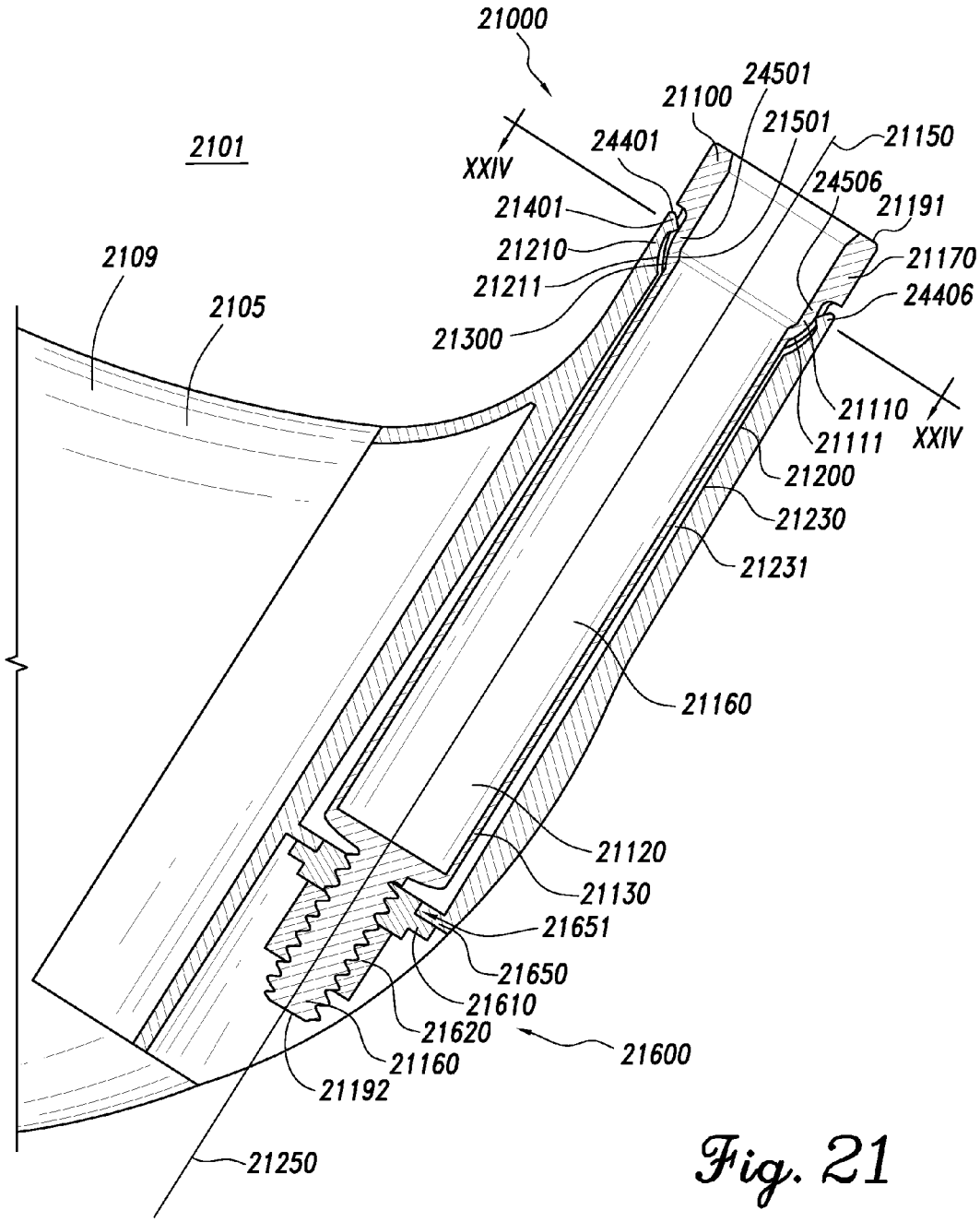
FIG. 21 illustrates a frontside view of a portion of a golf club head, showing a cross section of its golf coupling mechanism.
Figure 22:
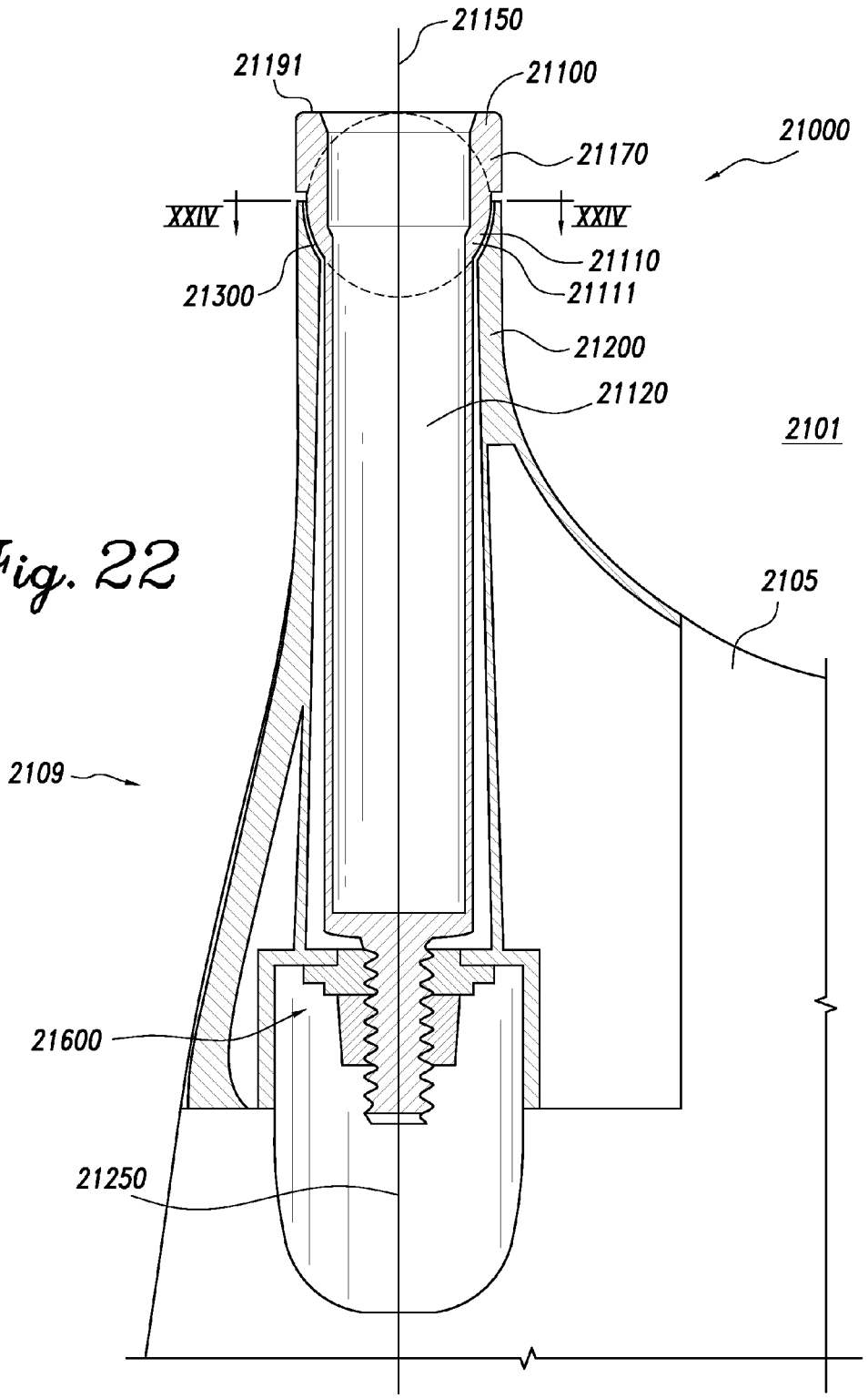
FIG. 22 illustrates a heelside view of a portion of the golf club head of FIG. 21, showing a cross section of its golf coupling mechanism.
Figure 23:
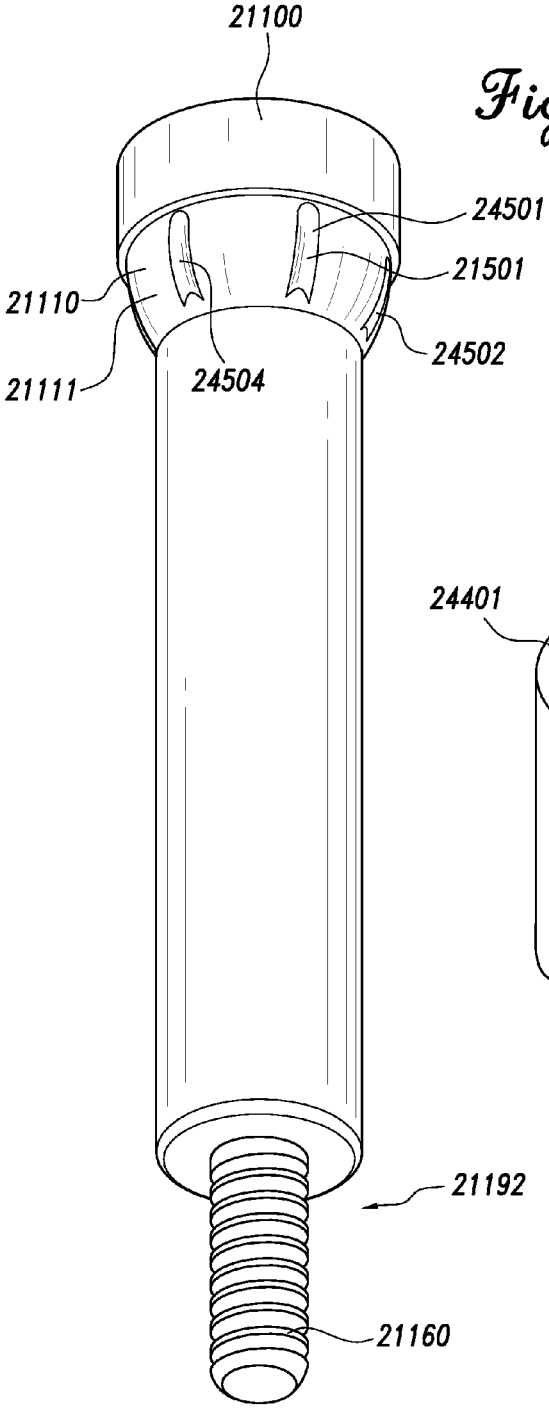
FIG. 23 illustrates a perspective view of a shaft sleeve of the golf coupling mechanism of FIG. 21.
Figure 27:
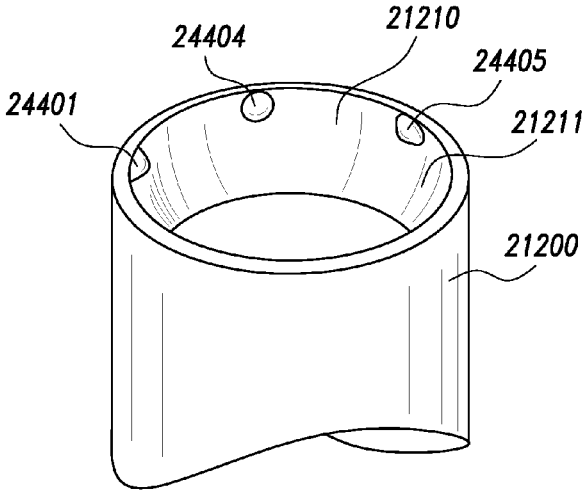
FIG. 27 illustrates a top perspective view of the hosel of the golf coupling mechanism of FIG. 21.
Figure 24:
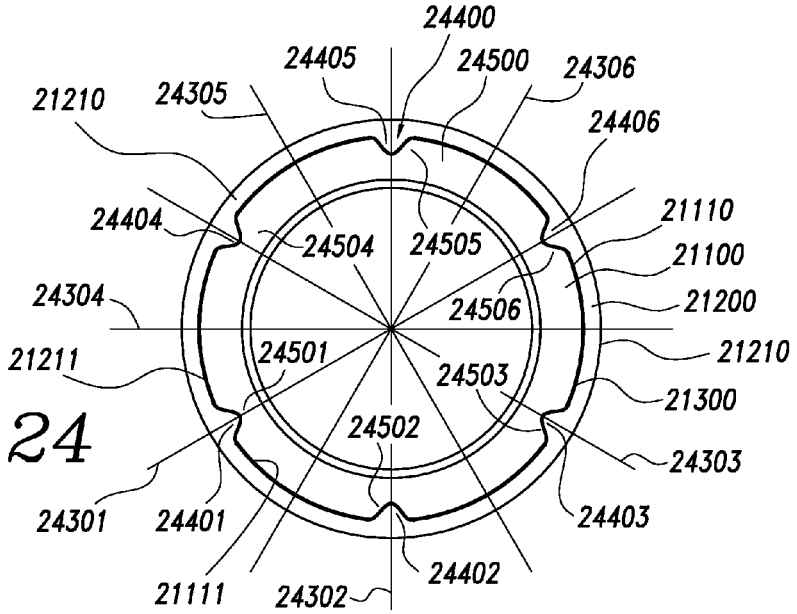
FIG. 24 illustrates a top cross-sectional view of the golf coupling mechanism of FIG. 21 along line XXIV-XXIV of FIG. 21.
Figure 25:
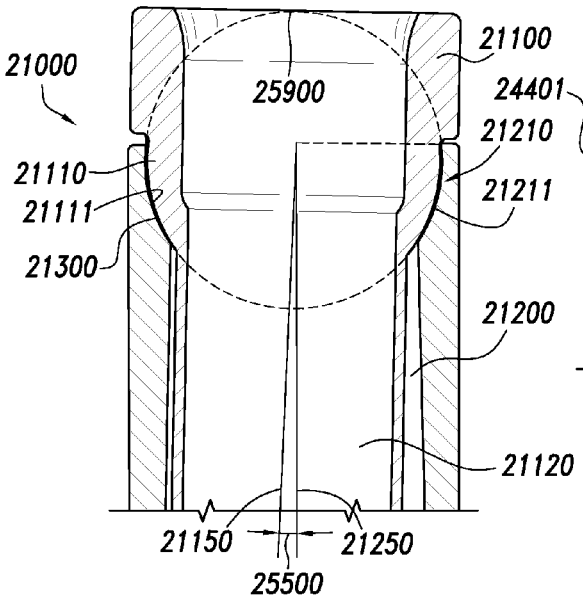
FIG. 25 illustrates a cross-sectional view of a portion of the golf coupling mechanism of FIG. 21 along line 24305 of FIG. 24, showing how the shaft sleeve is pivotable relative to the hosel to adjust an angle relationship therebetween.
Figure 26:
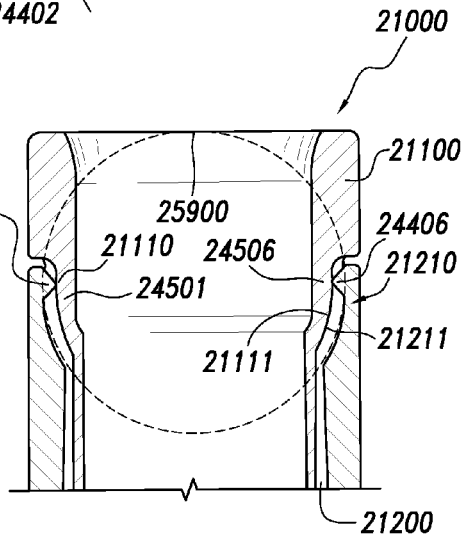
FIG. 26 illustrates a cross-sectional view of a portion of the golf coupling mechanism of FIG. 21 along line 24301 of FIG. 24.

Moving along, FIG. 21 illustrates a front view of a portion of golf club head 2101, showing a cross section of golf coupling mechanism 21000. FIG. 22 illustrates a heelside view of a portion of golf club head 2101, showing another cross section of golf coupling mechanism 21000. FIG. 23 illustrates a perspective view of shaft sleeve 21100 of golf coupling mechanism 21000. FIG. 24 illustrates a top cross-sectional view of golf coupling mechanism 21000 with respect to line XXIV-XXIV of FIG. 21. FIG. 25 illustrates a cross-sectional view of a portion of golf coupling mechanism 21000 along line 24305 of FIG. 24, showing how shaft sleeve 21100 is pivotable relative to hosel 21200 to adjust angle relationship 25500 therebetween. FIG. 26 illustrates a cross-sectional view of a portion of golf coupling mechanism 21000 along line 24301 of FIG. 24. FIG. 27 illustrates a top perspective view of a portion of hosel 21200 of golf coupling mechanism 21000 (FIG. 21).

In some examples, golf club head 2101 can be similar to golf club head 101 (FIGS. 1-4, 8-9), but comprises golf coupling mechanism 21000 instead of golf coupling mechanism 1000. In the present example, golf club head 2101 comprises head body 2105, hosel 21200 at head body 2105, and shaft sleeve 21100, where shaft sleeve 21100 is insertable into and removable from hosel 21200.

Shaft sleeve 21100 comprises sleeve bore 21120 configured to receive an end of a golf club shaft like golf club shaft 102 (FIG. 1). Shaft sleeve 21100 also comprises sleeve axis 21150 extending along a longitudinal centerline of sleeve bore 21120, between sleeve top end 21191 and sleeve bottom end 21192. In the present example, sleeve bore 21120 comprises a sleeve bore axis that is collinear with sleeve axis 21150. However, there can be other embodiments where sleeve bore 21120 could be tilted or non-coaxial relative to sleeve axis 21150, such as described above with respect to shaft bore axis 6150 of shaft bore 3120 tilted relative to sleeve axis 5150 of sleeve 1100 (FIG. 6).

Sleeve insertion portion 21160 of shaft sleeve 21100 is insertable into hosel 21200, and comprises sleeve wall 21130 bounding sleeve bore 21120. Sleeve top portion 21170 of shaft sleeve 21100 comprises sleeve top end 21191, and is configured to remain external to hosel 21200 while sleeve insertion portion 21160 is located in hosel bore 21231. Shaft sleeve 21100 also comprises sleeve top coupler 21110 located between sleeve top portion 21170 and sleeve insertion portion 21160. In the present example, sleeve top coupler 21110 bounds shaft sleeve 21100 around an outer perimeter thereof, and is centered about sleeve axis 21150.

Hosel 21200 comprises hosel inner wall 21230 defining hosel bore 21231 configured to receive sleeve insertion portion 21160 of shaft sleeve 21100. Hosel axis 21250 of hosel 21200 extends along a longitudinal centerline of hosel bore 21231. In the alignments shown in FIGS. 21-22, sleeve 2100 is aligned with hosel 21200 such that sleeve axis 21150 and hosel axis 21250 are collinear with each other. Nevertheless, as seen in FIG. 25, sleeve 2100 is pivotable relative to hosel 21200 to create or adjust angle relationship 25500 between sleeve axis 21150 and hosel axis 21250.

A top portion of hosel 21200 above hosel inner wall 21230 comprises hosel top coupler 21210, where hosel top coupler 21210 is configured to pivotably couple with sleeve top coupler 21110 to define pivot junction 21300 when shaft sleeve 21100 is located in hosel 21200. In the present example, sleeve top coupler 21110 comprises arcuate joint surface 21111, while hosel top coupler 21210 comprises arcuate socket surface 21211 complementary to, and configured to receive, arcuate joint surface 21111 of sleeve top coupler 21110. When sleeve insertion portion 21160 is in hosel bore 211231, arcuate joint surface 21111 of sleeve top coupler 21110 and arcuate socket surface 21211 of hosel top coupler 21210 are configured to slidably seat against each other to define pivot junction 21300 therebetween, where pivot junction 21300 enables displacement of sleeve insertion portion 21160 along a plurality of planes within hosel bore 21231. For example, shaft sleeve 21100 can be pivoted by pivot junction 21300 relative to hosel 21200 such that sleeve insertion portion 21160 is displaced within hosel bore 21321 along one or more of planes 24301-24306 (FIG. 24). Planes 24301-24306 can extend from top to bottom ends of hosel 21200 and comprise hosel axis 21250 (FIG. 21) in the present embodiment. In the same or other examples, shaft sleeve 21100 can be pivoted by pivot junction 21300 such that sleeve insertion portion 21160 is displaced along one or more non-planar paths, such as a conical path, within hosel bore 21321.

Each of arcuate joint surface 21111 and arcuate socket surface 21211 substantially conforms to a spheroidal segment shape in the present example. For instance, the spheroidal segment shape can be defined with respect to a radius of curvature of a reference sphere, such as reference sphere 25900 outlined in FIGS. 25-26. There can also be embodiments where arcuate joint surface 21111 and arcuate socket surface 21211 could conform to other arcuate shapes, such as an ellipsoidal segment shape.

Coupling mechanism 21000 comprises a keyway system configured to restrict rotation of shaft sleeve 21100 relative to hosel 21200 in the present example. As can be seen in FIG. 24, sleeve top coupler 21110 comprises sleeve keyway set 24500, while hosel top coupler 21210 comprises hosel keyway set 24400. Although sleeve keyway set 24500 comprises six keyway elements (sleeve keyway elements 24501-24506) and hosel keyway set 24400 comprises six keyway elements (hosel keyway elements 24401-24406) in the present example, there can be other embodiments with a different number of matching keyway elements and/or a different number of keyway elements per keyway set. For instance, one embodiment may comprise a sleeve keyway set similar to sleeve keyway set 24500 but having a single hosel keyway element.

In the present embodiment of FIGS. 21-27, sleeve keyway element 24501 (FIG. 24) is located at arcuate joint surface 21111 of sleeve top coupler 21110 and comprises sleeve keyway slot 21501 extending along a plane comprising sleeve axis 21150. Hosel keyway element 24401 (FIG. 24) is located at arcuate socket surface 21211 of hosel top coupler 21210 and comprises hosel keyway key 21401 in the present embodiment, protruding from arcuate socket surface 21211 of hosel top coupler 21210 to slidably engage sleeve keyway slot 21501 of sleeve keyway element 24501. When engaged with each other at pivot junction 21300, sleeve keyway element 24501 (FIG. 24) and hosel keyway element 24401 (FIG. 24) can restrict a rotation of shaft sleeve 21100 about hosel axis 21250 while still permitting displacement of sleeve insertion portion 21160 along a plurality of planes, and/or along one or more non-planar paths, within hosel bore 21231.

In the present example, sleeve keyway elements 24502-24506 (FIG. 24) are similar to sleeve keyway element 24501 (FIG. 24), but located elsewhere along arcuate joint surface 21111 of sleeve top coupler 21110. Similarly, hosel keyway elements 24402-24406 (FIG. 24) are similar to hosel keyway element 24401 (FIG. 24), but are located elsewhere along arcuate socket surface 21211 of hosel top coupler 21210. For example, hosel keyway elements 24401 (FIG. 24) and 24406 (FIG. 24) can be located 180 degrees apart from each other along arcuate socket surface 21211, and adjacent ones of hosel keyway elements 24401-24406 (FIG. 24) can be separated by 60 degrees from each other in the present embodiment.

The displacements of sleeve insertion portion 21160 within hosel bore 21231, as described above and as permitted by pivot junction 21300, can allow adjustment of angle relationship 25500 (FIG. 25) with respect to magnitude or direction. In some examples, angle relationship 25500 (FIG. 25) can be adjustable from zero degrees to 5 degrees between sleeve axis 21150 and hosel axis 21250. In the same or other embodiments, shaft sleeve 21100 can be pivoted along a plurality of planes or along one or more non-planar paths as described above to place angle relationship 25500 (FIG. 25) at desired relationship or direction with respect to hosel 21200 or club head 2101. By adjusting angle relationship 25500 (FIG. 25), at least one of a lie angle or a loft angle of club head 2101 can be accordingly adjusted.

As can be seen in FIGS. 21-22, golf club head 2101 also comprises securing mechanism 21600 configured to pull sleeve top coupler 21110 and hosel top coupler 21210 against each other at pivot junction 21300, and to secure sleeve axis 21150 at a first angle relative to hosel axis 21250. In some examples, the first angle can be zero degrees, such that sleeve axis 21150 and hosel axis 21250 are collinear with each other as illustrated in FIGS. 21-22. In other examples, the first angle can be different than zero, as described above with respect to angle relationship 25500 (FIG. 25).

Securing mechanism 21600 comprises locking surface 21650 of head body 2105, passageway 21651 located at a bottom end of hosel 21200 to link hosel bore 21231 with locking surface 21650, sleeve bottom coupler 21160 at a bottom of shaft sleeve 21100, and fastener 21620. Fastener 21620 and sleeve bottom coupler 21160 are configured to engage each other via passageway 21651 through locking surface 21650. In the present example, fastener 21620 comprises a female threaded fastener while sleeve bottom coupler 21160 comprises a male threaded fastener. There can be other embodiments, however, where fastener 21620 can comprise a male threaded fastener while sleeve bottom coupler 21160 can comprise a female threaded fastener.

Figure 28:
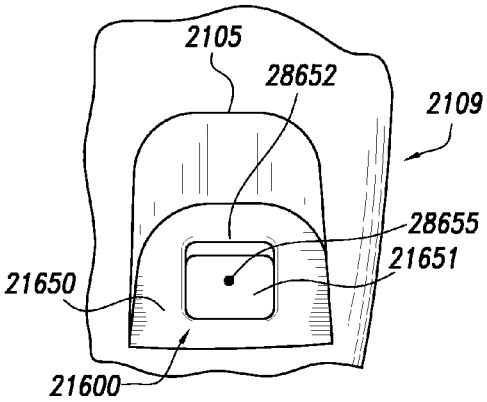
FIG. 28 illustrates a bottom aspect view of the golf club head of FIG. 21, focusing on a locking surface and passageway of a securing mechanism of the golf coupling mechanism of FIG. 21.

As seen in FIGS. 21-22, securing mechanism 21600 comprises washer 21610 between fastener 21620 and locking surface 21650, where washer 21610 is configured to place shaft sleeve 21100 in a plurality of positions so that angle relationship 25500 (FIG. 25) between shaft sleeve 21100 and hosel 21200 can be adjusted in a plurality of magnitudes or directions. FIG. 28 illustrates a bottom aspect view of golf club head 2101, focusing on locking surface 21650 and passageway 21651 of securing mechanism 21600. Locking surface 21650 comprises passageway perimeter 28652 bounding passageway 21651, which has a passageway centerpoint 28655, and washer 21610 (FIG. 21) is configured to engage passageway perimeter 28652 and shaft sleeve 21100 to position shaft sleeve 21100 as desired relative to hosel 21210 (FIG. 21).

Figure 29:
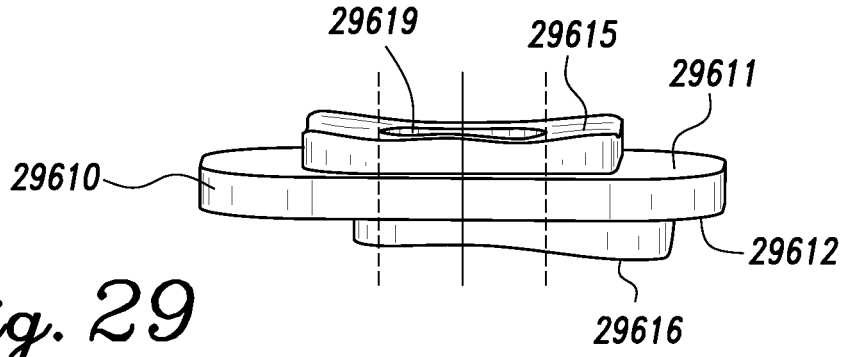
FIG. 29 illustrates a side view of an exemplary washer for the locking surface of the securing mechanism of FIG. 21.
Figure 30:
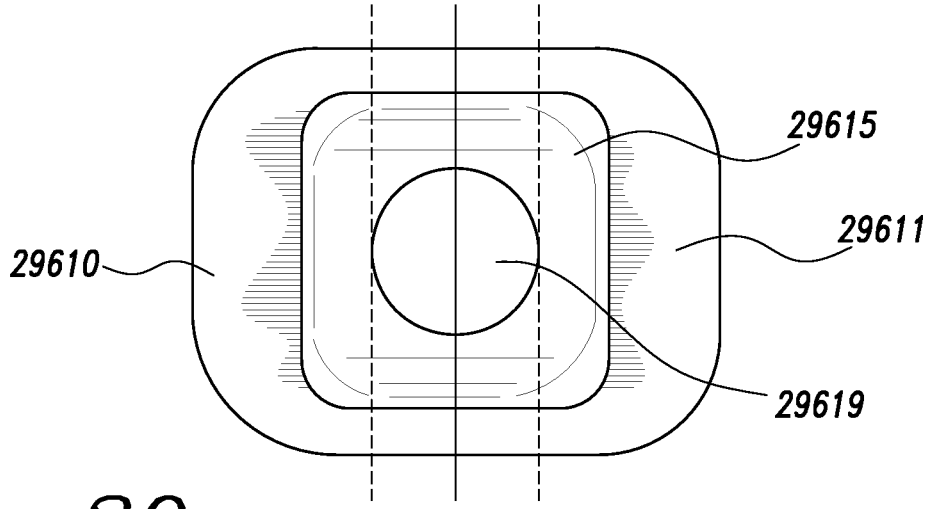
FIG. 30 illustrates a view of a washer side of the washer of FIG. 29.
Figure 49:
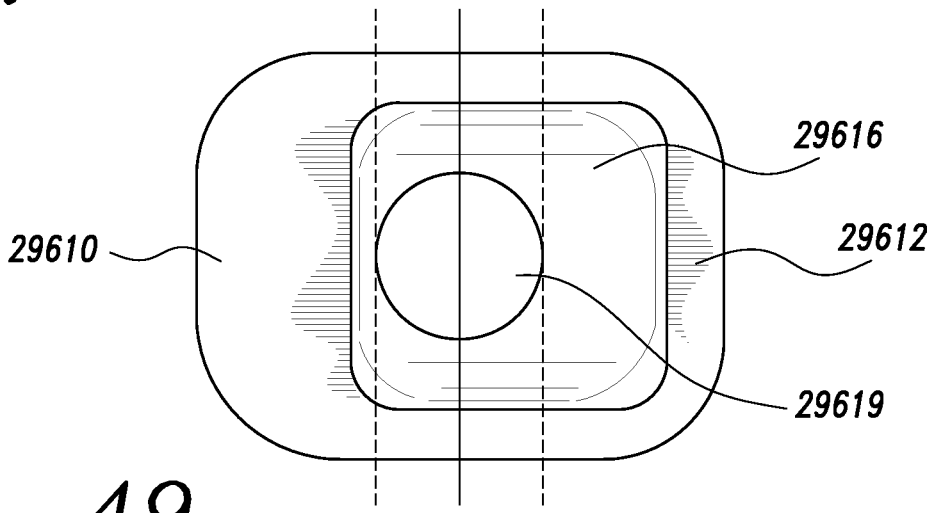
FIG. 49 illustrates a view of a different washer side of the washer of FIG. 29.

FIG. 29 illustrates a side view of washer 29610. In some embodiments, washer 21610 (FIGS. 21-22) can comprise washer 29610 of FIG. 29. FIG. 30 illustrates a view of a first washer side 29611 of washer 21610. Skipping ahead in the figures, FIG. 49 illustrates a view of a second washer side 29612 of washer 21610, where second washer side 29612 is opposite to first washer side 29611. Washer side 29611 comprises washer form 29615, which is complementary to passageway perimeter 28652 (FIG. 28). Similarly, washer side 29612 comprises washer form 29616, which is also complementary to passageway perimeter 28652 (FIG. 28). Washer 29610 also comprises washer channel 29619 extending from washer side 29612 to washer side 29611. In the present example, passageway perimeter 28652 (FIG. 28), washer form 29615, and washer forms 29616 comprise non-circular complementary borders configured to restrict rotation of washer 29610 relative to locking surface 21650 (FIG. 21).

Washer forms 29615 and 29616 are offset from each other in the present example. As can be seen in FIG. 30, at washer side 29611, washer channel 29619 is substantially centered relative to washer form 29615. In contrast, as can be seen in FIG. 49, at washer side 29612, washer channel 29619 is offset or non-centered relative to washer form 29616.

Figure 31:
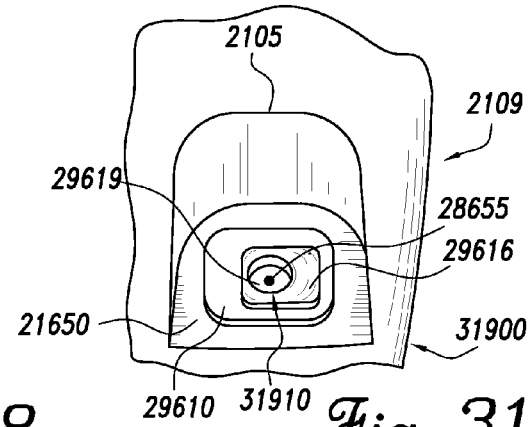
FIGS. 31-35 show bottom aspect views of the golf club head of FIG. 21, with the washer of FIG. 29 coupled to the locking surface of FIG. 28 in different respective orientations.

In the present example, washer 29610 can be flipped over such that either one of washer forms 29615 or 29616 can engage passageway perimeter 28652 (FIG. 28) in a plurality of orientations. For example, FIG. 31 shows a bottom aspect view of golf club head 2101, with washer 29610 coupled to locking surface 21650 in orientation 31900, where washer form 29615 (FIG. 29) is engaged with passageway perimeter 28652 (FIG. 28), and where washer form 29616 faces away from locking surface 21650. Location 31910 of washer channel 29619 in the present example is concentric with passageway centerpoint 28655. In some examples, where location 31910 of washer channel 29616 is established via orientation 31900, when fastener 21620 (FIG. 21) and sleeve bottom coupler 21160 (FIG. 21) engage each other via passageway 21651 (FIG. 21) and washer channel 29619, sleeve axis 21150 (FIG. 21) and hosel axis 21250 (FIG. 21) can be substantially collinear such that angle relationship 25500 (FIG. 25) therebetween can comprise an angle of approximately zero degrees.

Figure 32:
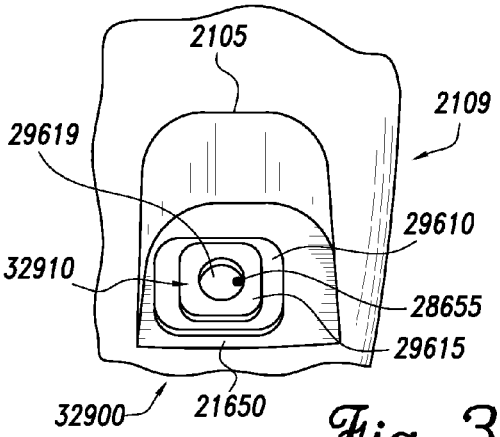
Figure 33:
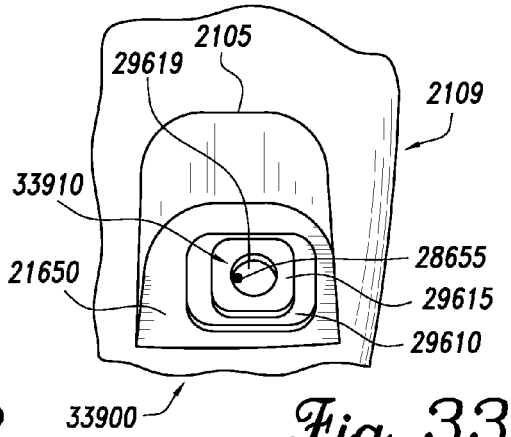
Figure 34:
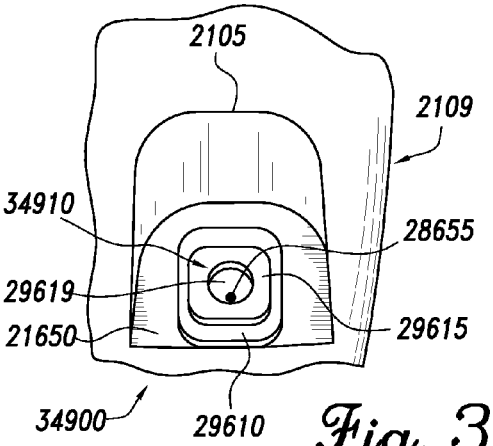
Figure 35:
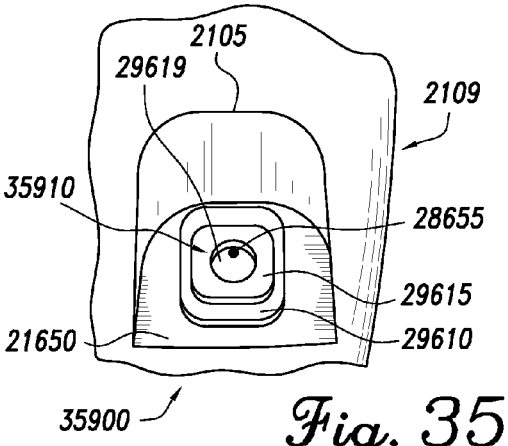

FIGS. 32-35 show bottom aspect views of golf club head 2101, with washer 29610 coupled to locking surface 21650 in a plurality of corresponding orientations, where washer form 29616 is engaged with passageway perimeter 28652 (FIG. 28), and where washer form 29615 faces away from locking surface 21650. In the alignment of FIG. 32, washer form 29616 (FIG. 29) engages passageway perimeter 28652 (FIG. 28) in orientation 32900 configured to position washer channel 29619 at location 32910 relative to passageway centerpoint 28655 of passageway 21651 (FIG. 28). In the alignment of FIG. 33, washer form 29616 (FIG. 29) engages passageway perimeter 28652 (FIG. 28) in orientation 33900 configured to position washer channel 29619 at location 33910 relative to passageway centerpoint 28655 of passageway 21651 (FIG. 28). In the alignment of FIG. 34, washer form 29616 (FIG. 29) engages passageway perimeter 28652 (FIG. 28) in orientation 34900 configured to position washer channel 29619 at location 34910 relative to passageway centerpoint 28655 of passageway 21651 (FIG. 28). In the alignment of FIG. 35, washer form 29616 (FIG. 29) engages passageway perimeter 28652 (FIG. 28) in orientation 35900 configured to position washer channel 29619 at location 35910 relative to passageway centerpoint 28655 of passageway 21651 (FIG. 28).

Locations 32910, 33910, 34910, and 35910 of washer channel 29619 in the examples of FIGS. 32-35 are offset or non-centered relative to passageway centerpoint 28655. For example, FIG. 32 shows location 32910 of washer channel 29619 offset away from strike face 2109 of club head 2101 relative to passageway centerpoint 28655. FIG. 33 shows location 33910 of washer channel 29619 offset towards strike face 2109 of club head 2101 relative to passageway centerpoint 28655. FIG. 34 shows location 34910 of washer channel 29619 offset towards a toe portion of club head 2101 relative to passageway centerpoint 28655. FIG. 35 shows location 35910 of washer channel 29619 offset towards a heel portion of club head 2101 relative to passageway centerpoint 28655. With respect to the alignments shown in FIGS. 32-35, orientations 32900 and 33900 differ from each other by approximately 180 degrees, and orientations 34900 and 35900 also differ from each other by approximately 180 degrees.

In some examples, where locations 32910, 33910, 34910, or 35910 of washer channel 29616 are established via respective orientations 32900, 33900, 34900, or 35900 when fastener 21620 (FIG. 21) and sleeve bottom coupler 21160 (FIG. 21) engage each other via passageway 21651 (FIG. 28) and washer channel 29619, sleeve axis 21150 (FIG. 25) and hosel axis 21250 (FIG. 25) can be non-collinear such that angle relationship 25500 (FIG. 25) therebetween can comprise an angle with a magnitude greater than zero degrees. Other locations and corresponding offsets of washer channel 29619 relative to passageway centerpoint 28655 can be attained in similar embodiments.

As described above with respect to FIGS. 28-35, washer 29610 is configured to engage passageway perimeter 28652 in five different orientations (orientation 31900 of FIG. 31, orientation 32900 of FIG. 32, orientation 33900 of FIG. 33, orientation 34900 of FIG. 34, and orientation 35900 of FIG. 35), and is thus able to adjust angle relationship 25500 (FIG. 25) between sleeve axis 21150 and hosel axis 21250 in five different angles.

There can be other embodiments where washer 21610 (FIG. 21-22) can comprise other washer(s) similar to washer 29610 (FIGS. 29-35), but where the number of orientations and corresponding angles for angle relationship 25500 afforded by such other washer(s) may be different. For example, in one embodiment, the washer can be similar to washer 29610 (FIGS. 29-35), but where such washer may be configured to engage passageway perimeter 28652 (FIG. 28) in only three different orientations to adjust angle relationship 25500 (FIG. 25) between sleeve axis 21150 and hosel axis 21250 in three different angles. In one implementation, such three different orientations may be similar to a subset of orientations 31900, 32900, 33900, 34900, or 35900 shown in FIGS. 31-35.

Figure 36:
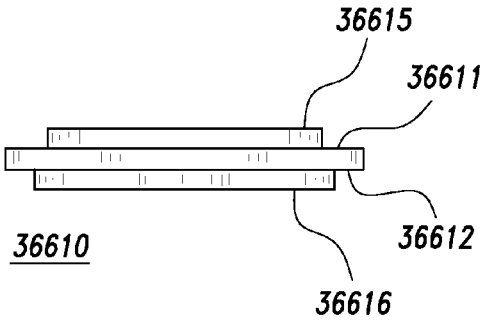
FIG. 36 illustrates a side view of another exemplary washer for the locking surface of the securing mechanism of FIG. 21.
Figure 37:
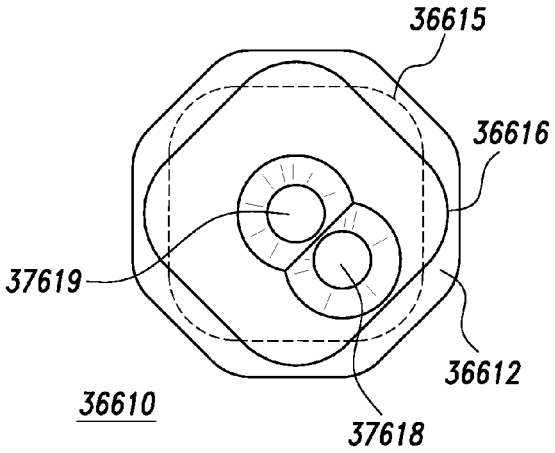
FIG. 37 illustrates an X-ray top view of the washer of FIG. 36.
Figure 38:
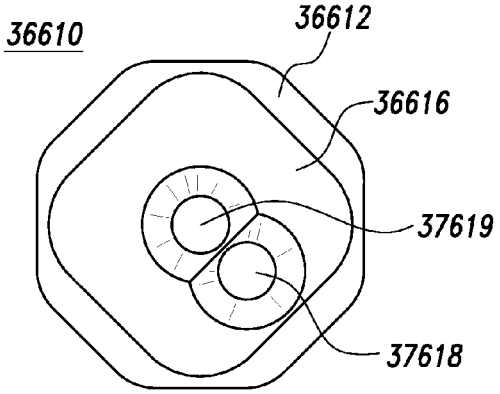
FIG. 38 illustrates a view of a first washer side of the washer of FIG. 36.
Figure 39:
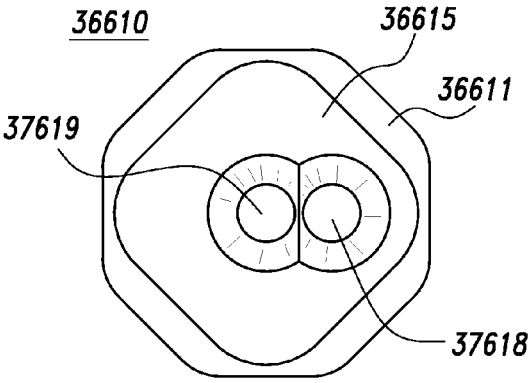
FIG. 39 illustrates a view of a second opposite washer side of the washer of FIG. 36.

In another embodiment, the washer can provide more than six orientations, such as in the case of washer 36610 (FIG. 36) or variations thereof. FIG. 36 illustrates a side view of washer 36610 with washer form 36615 at washer side 36611, and washer form 36616 at washer side 36612. FIG. 37 illustrates an X-ray top view of washer 36610, showing washer form 36616 thereof at washer side 36612, and showing washer form 36615 in ghost. FIG. 38 illustrates a view of washer side 36612 of washer 36610. FIG. 39 illustrates a view of washer side 36611 of washer 36610. Washer forms 36615-36616 of washer 36610 can be can be complementary to passageway perimeter 28652 (FIG. 28) of passageway 21651 (FIG. 28) at locking surface 21650 (FIG. 28), and can attain different orientations relative to passageway 21651 (FIG. 28) similar to washer forms 29615-29616 of washer 29610 in FIGS. 29-31. In the present embodiment, as seen in FIGS. 37-39, washer 36910 comprises washer channel 37618 extending from washer side 36611 to washer side 36612, where washer channel 37618 is non-centered relative to washer form 36615. Washer channel 37618 is also non-centered relative to washer form 36616 in the present example.

Figure 40:
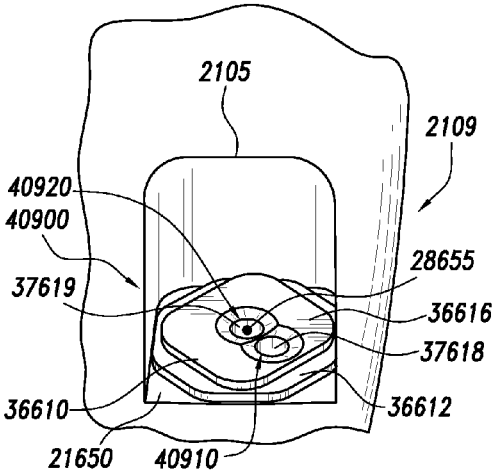
FIGS. 40-47 show bottom aspect views of the golf club head of FIG. 21, with the washer of FIG. 36 coupled to the locking surface of FIG. 28 in different respective orientations.
Figure 41:
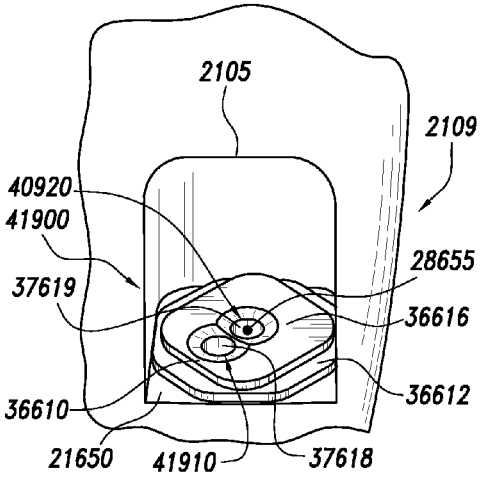
Figure 42:
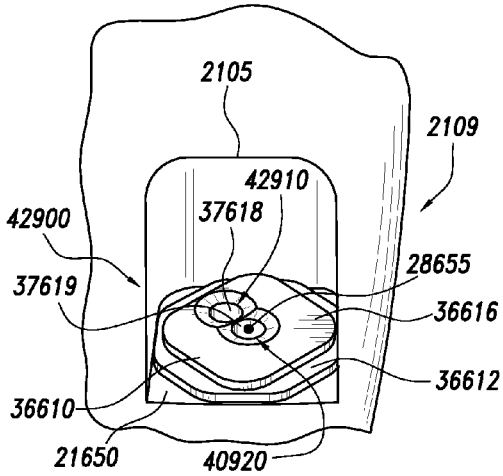
Figure 43:
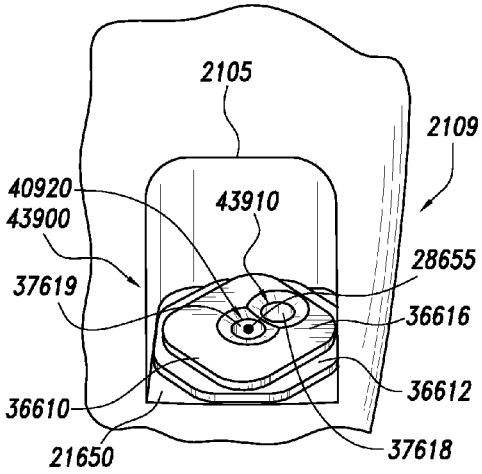

FIGS. 40-43 show bottom aspect views of golf club head 2101, with washer 36610 coupled to locking surface 21650 in a plurality of corresponding orientations, where washer form 36615 (FIGS. 36, 37, 39) is engaged with passageway perimeter 28652 (FIG. 28), and where washer form 36616 faces away from locking surface 21650. In the alignment of FIG. 40, washer form 36615 (FIGS. 36, 37, 39) engages passageway perimeter 28652 (FIG. 28) in orientation 40900 configured to position washer channel 37618 at location 40910 relative to passageway centerpoint 28655 of passageway 21651 (FIG. 28). In the alignment of FIG. 41, washer form 36615 (FIGS. 36, 37, 39) engages passageway perimeter 28652 (FIG. 28) in orientation 41900 configured to position washer channel 37618 at location 41910 relative to passageway centerpoint 28655 of passageway 21651 (FIG. 28). In the alignment of FIG. 42, washer form 36615 (FIGS. 36, 37, 39) engages passageway perimeter 28652 (FIG. 28) in orientation 42900 configured to position washer channel 37618 at location 42910 relative to passageway centerpoint 28655 of passageway 21651 (FIG. 28). In the alignment of FIG. 43, washer form 36615 (FIGS. 36, 37, 39) engages passageway perimeter 28652 (FIG. 28) in orientation 43900 configured to position washer channel 37618 at location 43910 relative to passageway centerpoint 28655 of passageway 21651 (FIG. 28).

Locations 40910, 41910, 42910, and 43910 of washer channel 37618 in the examples of FIGS. 40-43 are offset or non-centered relative to passageway centerpoint 28655. For example, FIG. 40 shows location 40910 of washer channel 37618 offset towards a front-heel portion of club head 2101 relative to passageway centerpoint 28655. FIG. 41 shows location 41910 of washer channel 37618 offset towards a rear-heel portion of club head 2101 relative to passageway centerpoint 28655. FIG. 42 shows location 42910 of washer channel 37618 offset towards a rear-toe portion of club head 2101 relative to passageway centerpoint 28655. FIG. 43 shows location 43910 of washer channel 37618 offset towards a front-toe portion of club head 2101 relative to passageway centerpoint 28655.

Figure 44:
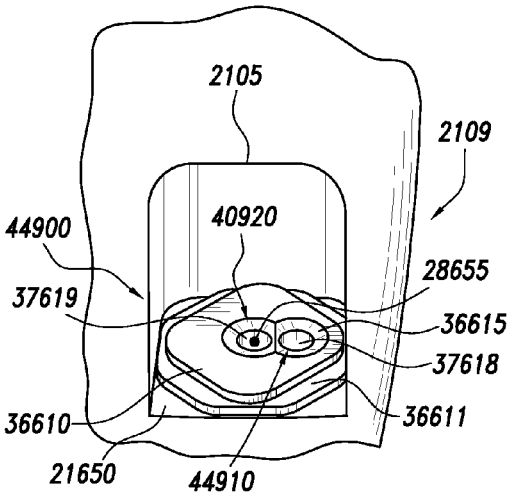
Figure 45:
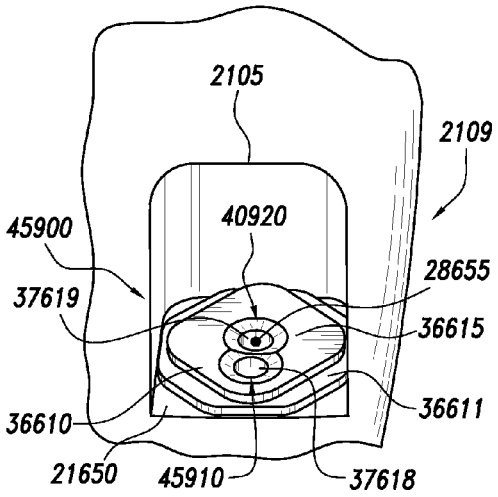
Figure 46:
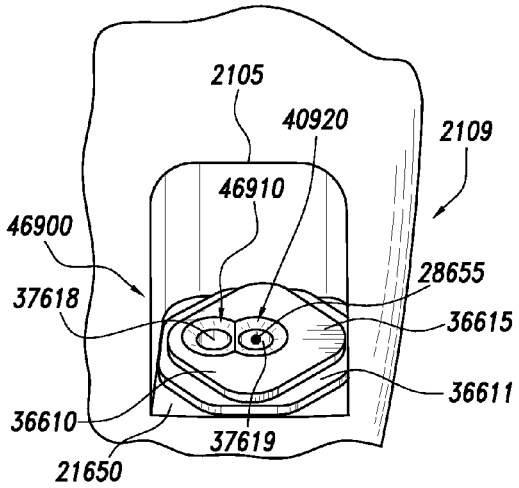
Figure 47:
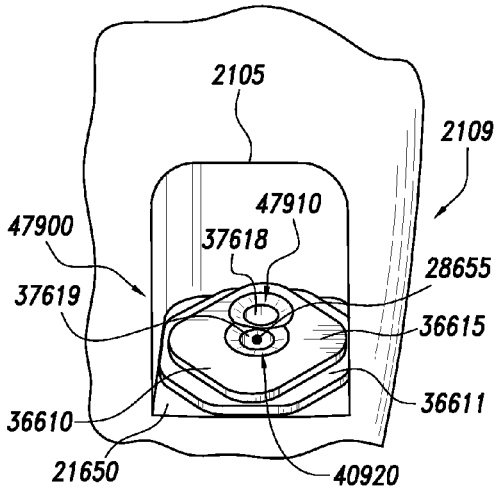

FIGS. 44-47 show bottom aspect views of golf club head 2101, with washer 36610 coupled to locking surface 21650 in a plurality of corresponding orientations, where washer form 36616 (FIGS. 36, 37, 38) is engaged with passageway perimeter 28652 (FIG. 28), and where washer form 36616 faces away from locking surface 21650. In the alignment of FIG. 44, washer form 36616 (FIGS. 36, 37, 38) engages passageway perimeter 28652 (FIG. 28) in orientation 44900 configured to position washer channel 37618 at location 44910 relative to passageway centerpoint 28655 of passageway 21651 (FIG. 28). In the alignment of FIG. 45, washer form 36616 (FIGS. 36, 37, 38) engages passageway perimeter 28652 (FIG. 28) in orientation 46900 configured to position washer channel 37618 at location 45910 relative to passageway centerpoint 28655 of passageway 21651 (FIG. 28). In the alignment of FIG. 46, washer form 36616 (FIGS. 36, 37, 38) engages passageway perimeter 28652 (FIG. 28) in orientation 46900 configured to position washer channel 37618 at location 46910 relative to passageway centerpoint 28655 of passageway 21651 (FIG. 28). In the alignment of FIG. 47, washer form 36616 (FIGS. 36, 37, 38) engages passageway perimeter 28652 (FIG. 28) in orientation 47900 configured to position washer channel 37618 at location 47910 relative to passageway centerpoint 28655 of passageway 21651 (FIG. 28).

Locations 44910, 45910, 46910, and 47910 of washer channel 37618 in the examples of FIGS. 44-47 are offset or non-centered relative to passageway centerpoint 28655. For example, FIG. 44 shows location 44910 of washer channel 37618 offset towards strikeface 2109 and/or front portion of club head 2101 relative to passageway centerpoint 28655. FIG. 45 shows location 45910 of washer channel 37618 offset towards a heel portion of club head 2101 relative to passageway centerpoint 28655. FIG. 46 shows location 46910 of washer channel 37618 offset away from strikeface 2109 and/or towards a rear portion of club head 2101 relative to passageway centerpoint 28655. FIG. 47 shows location 47910 of washer channel 37618 offset towards a toe portion of club head 2101 relative to passageway centerpoint 28655.

In some examples, where locations 40910, 41910, 42910, 43910, 44910, 45910, 46910, or 47910, of washer channel 37618 are established via respective orientations 40900 (FIG. 40), 41900 (FIG. 41), 42900 (FIG. 42), 43900 (FIG. 43), 44900 (FIG. 44), 45900 (FIG. 45), 46900 (FIG. 46), or 47900 (FIG. 47), when fastener 21620 (FIG. 21) and sleeve bottom coupler 21160 (FIG. 21) engage each other via passageway 21651 (FIG. 21) and washer channel 37619, sleeve axis 21150 (FIG. 25) and hosel axis 21250 (FIG. 25) can be non-collinear such that angle relationship 25500 therebetween can comprise an angle with a magnitude greater than zero degrees. Other locations and corresponding offsets of washer channel 37618 relative to passageway centerpoint 28655 can be attained in other similar embodiments.

As described above with respect to FIGS. 36-47, washer 36610 is configured to engage passageway perimeter 28652 (FIG. 28) in eight different orientations (orientation 40900 of FIG. 40, orientation 41900 of FIG. 41, orientation 42900 of FIG. 42, orientation 43900 of FIG. 43, orientation 44900 of FIG. 44, orientation 45900 of FIG. 45, orientation 46900 of FIG. 46, and orientation 47900 of FIG. 47), and is thus able to adjust angle relationship 25500 (FIG. 25) between sleeve axis 21150 (FIG. 25) and hosel axis 21250 (FIG. 25) in eight different angles via washer channel 37618.

In addition, in the present embodiment of FIGS. 36-47, washer 36610 also comprises washer channel 37619 which extends from washer side 36611 to washer side 36612. In the present example, washer channel 37619 is substantially centered relative to at least washer form 36615, and when washer form 36615 is engaged to passageway perimeter 28652 (FIG. 28), as shown in FIGS. 40-43, washer channel 37619 is positioned at location 40920 relative to passageway centerpoint 28655 of passageway 21651 (FIG. 28). Location 40920 of washer channel 37619 in the present example, as shown in FIGS. 40-43, is concentric with passageway centerpoint 28655. Washer channel 37619 is also substantially centered relative to washer form 36616 in the present embodiment, and when washer form 36616 is engaged to passageway perimeter 28652 (FIG. 28), as shown in FIGS. 44-47, washer channel 37619 remains positioned at location 40920 like in FIGS. 40-43.

In some examples, where location 40920 of washer channel 37619 is established as shown in FIGS. 40-47, when fastener 21620 (FIG. 21) and sleeve bottom coupler 21160 (FIGS. 21-22) engage each other via passageway 21651 (FIG. 21) and via washer channel 37619 (FIGS. 37-47), sleeve axis 21150 (FIG. 25) and hosel axis 21250 (FIG. 25) can be substantially collinear such that angle relationship 25500 (FIG. 25) therebetween can comprise an angle of approximately zero degrees. Having both washer channels 37618 and 37619, washer 36610 is thus able to adjust angle relationship 25500 (FIG. 25) between sleeve axis 21150 (FIG. 28) and hosel axis 21250 (FIG. 28) in nine different angles (eight via washer channel 37618 and one via washer channel 37619), with just the eight orientations described for FIGS. 40-47.

In other examples, washer channel 37619 may be non-centered, with a different offset than that of washer channel 37618 relative to washer form 36616 and/or washer form 36616 of washer 36610 (FIGS. 36-39). In such examples, washer channel 37619 could permit a different set of angles (e.g., eight other angles) for angle relationship 25500 (FIG. 25), in addition to those permitted by washer channel 37618 as described above with respect to FIGS. 40-47.

There can be other embodiments where washer 21610 (FIGS. 21-22) can comprise other washer(s) similar to washer 36610 (FIGS. 36-47), but where the number of orientations and corresponding angles for angle relationship 25500 afforded by such other washer(s) may be different. In one embodiment, washer 21610 (FIG. 21-22) may comprise a washer similar to washer 36610 (FIGS. 36-47), where such washer may be configured to engage passageway perimeter 28652 (FIG. 28) in four different orientations (rather than eight), to adjust angle relationship 25500 (FIG. 25) between sleeve axis 21150 (FIG. 25) and hosel axis 21250 (FIG. 25) in five different angles. In one implementation, such four different orientations may be similar to a subset of orientations 40900, 41900, 41900, 43900, 44900, 45900, 46900, or 47900 shown in FIGS. 40-47.

Figure 48:
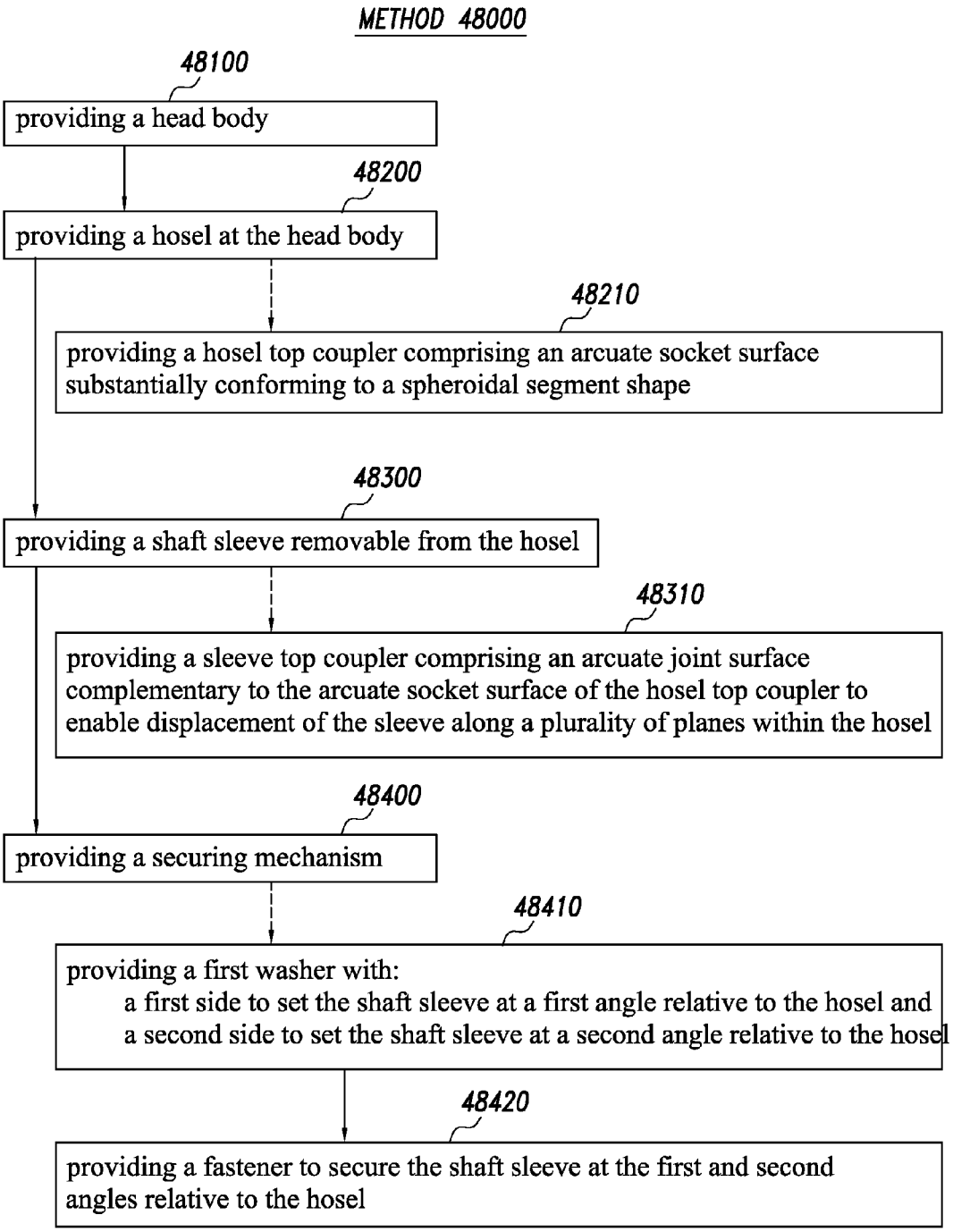
FIG. 48 illustrates a flowchart for a method that can be used to provide, form, and/or manufacture a golf coupler mechanism in accordance with the present disclosure.

FIG. 48 illustrates a flowchart for method 48000, which can be used to provide, form, and/or manufacture a golf club head coupler mechanism in accordance with the present disclosure. In some examples, the golf club head can be similar to golf club head 2101 of FIGS. 21-22, comprising elements and/or features similar to those described with respect to FIGS. 21-48.

Method 48000 comprises block 48100 for providing a head body of the golf club head. In some examples, the head body can be similar to head body 2105 (FIGS. 21-22, 28, 31-35, 40-47), and/or may comprise features or elements similar to those described above with respect to head body 2105.

Method 48000 also comprises block 48200 for providing a hosel at the head body. In some examples, the hosel can be similar to hosel 21200 (FIGS. 21-22, 24-26), and/or may comprise features or elements similar to those described above with respect to hosel 21200.

In some implementations, block 48200 can comprise sub block 48210 for providing a hosel top coupler comprising an arcuate or other socket surface substantially conforming to a spheroidal or other segment shape. The hosel top coupler can be similar to hosel top coupler 21210 (FIGS. 21-22, 25-27), and the arcuate socket surface can be similar to arcuate socket surface 21211 (FIGS. 21-22, 25-27) as described above. The hosel top coupler can comprise further features or elements similar to those described above with respect to hosel top coupler 21210.

Method 48000 can also comprise block 48300 for providing a shaft sleeve removable from the hosel. In some examples, the shaft sleeve can be similar to shaft sleeve 21100 (FIGS. 21-26), and/or may comprise features or elements similar to those described above with respect to shaft sleeve 21100.

In some implementations, block 48300 can comprise sub block 48310 for providing a sleeve top coupler comprising an arcuate or other joint surface complementary to the arcuate or other socket surface of the hosel top coupler to enable displacement of the sleeve along a plurality of planes within the hosel. Sleeve top coupler can be similar to sleeve top coupler 21110 (FIGS. 21-26), and the arcuate joint surface can be similar to arcuate joint surface 21111 (FIGS. 21-23, 25-26). The sleeve top coupler can comprise further features or elements similar to those described above with respect to sleeve top coupler 21110.

Method 48000 can also comprise block 48400 for providing a securing mechanism in some embodiments. As an example, the securing mechanism can be similar to securing mechanism 21600 (FIGS. 21-22), and/or may comprise features or elements similar to those described above with respect to securing mechanism 21600. For example, the securing mechanism may comprise a locking surface similar to locking surface 21650 (FIGS. 21-22, 28, 31-35, 40-47), a passageway similar to passageway 21651 (FIGS. 21-22, 28), a passageway perimeter similar to passageway perimeter 28652 (FIG. 28), a sleeve bottom coupler similar to sleeve bottom coupler 21160 (FIGS. 21-23), and/or other features or elements of securing mechanism 21600 (FIG. 21)

Block 48400 can comprise sub block 48410 for providing a first washer with a first side to set the shaft sleeve at a first angle relative to the hosel and a second side to set the shaft sleeve at a second angle relative to the hosel. In some examples, the first washer can be similar to washer 21610 (FIGS. 21-22) which, as described above, can comprise or be similar to washer 29610 (with washer sides 29611-29612 and washer forms 29615-29616) (FIGS. 29-35), and/or can comprise or be similar to washer 36610 (with washer sides 36611-36612 and washer forms 36615-36616) (FIGS. 36-47).

Method 48000 can also comprise sub block 48420 for providing a fastener to secure the shaft sleeve at first and second angles relative to the hosel. In some examples, the fastener can be similar to fastener 21620 (FIGS. 21-22). In the same or other examples, the first and second angles can be similar to angle relationship 25500 (FIG. 25), as adjusted via the washer pursuant to respective ones of the orientations or alignments described with respect to FIGS. 31-35 or FIGS. 40-47.

In some examples, one or more of the different blocks of method 48000 can be combined into a single block or performed simultaneously, and/or the sequence of such blocks can be changed. For example, in some embodiments, blocks 48100 and 48200 may be combined if desired. In the same or other examples, some of the blocks of method 18000 can be subdivided into several sub-blocks. As an example, block 48400 may comprise one or more further sub-blocks for providing additional features of the securing mechanism, such as the locking surface, the sleeve bottom coupler, and/or the passageway through the locking surface. There also can be examples where method 48000 can comprise further or different blocks. As an example, method 48000 may comprise another block for providing or coupling a shaft to the shaft sleeve of block 48300. In addition, there may be examples where method 48000 can comprise only part of the blocks described above. Other variations can be implemented for method 48000 without departing from the scope of the present disclosure.

Although the golf coupling mechanisms and related methods herein have been described with reference to specific embodiments, various changes may be made without departing from the spirit or scope of the present disclosure. As an example, there may be embodiments where sleeve coupler set 3110 (FIGS. 3-7, 10, 14-17) and/or sleeve coupler set 12110 (FIG. 12) can comprise only two sleeve couplers, and where receiver coupler set 3210 (FIGS. 3-4, 8-9, 11, 14-17) and receiver coupler set 13210 (FIG. 13) can comprise only two receiver couplers. In such embodiments, only two configurations may be possible between the shaft sleeve and the shaft receiver, and the golf coupler set may permit adjustment between two lie angles or two loft angles. Of course, there also can be embodiments with sleeve coupler sets having three, five, six, seven, eight, or more sleeve couplers, and receiver coupler sets having three, five, six, seven eight, or more receiver couplers, with corresponding increases in the number of possible lie and loft angle combinations.

As another example, the embodiments described with respect to FIGS. 21-48 can be modified such that fastener 21620 can comprise a male threaded fastener while sleeve bottom coupler 21160 can comprise a female threaded fastener (FIGS. 21-23). In the same or other example, the embodiments described with respect to FIGS. 21-48 can be modified to invert the relationship between sleeve keyway set 24500 and hosel keyway set 24400, where sleeve keyway set 24500 would comprise keyway keys similar to those of hosel keyway elements 24401-24406, and where hosel keyway set 25500 would comprise keyway slots similar to those of sleeve keyway elements 24501-24506 (FIGS. 21-27).

Additional examples of such changes and others have been given in the foregoing description. Other permutations of the different embodiments having one or more of the features of the various figures are likewise contemplated. Accordingly, the specification, claims, and drawings herein are intended to be illustrative of the scope of the disclosure and is not intended to be limiting. It is intended that the scope of this application shall be limited only to the extent required by the appended claims.

The golf coupling mechanisms and related methods discussed herein may be implemented in a variety of embodiments, and the foregoing discussion of certain of these embodiments does not necessarily represent a complete description of all possible embodiments. Rather, the detailed description of the drawings, and the drawings themselves, disclose at least one preferred embodiment, and may disclose alternative embodiments.

All elements claimed in any particular claim are essential to the embodiment claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims, unless such benefits, advantages, solutions, or elements are expressly stated in such claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

While the above examples may be described in connection with a driver-type golf club, the apparatus, methods, and articles of manufacture described herein may be applicable to other types of golf club such as a fairway wood-type golf club, a hybrid-type golf club, an iron-type golf club, a wedge-type golf club, or a putter-type golf club. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. A golf club head comprising:
a head body;
a hosel at the head body;
a shaft sleeve removable from the hosel; and
an adjustment mechanism comprising a first washer securing mechanism;
wherein:
the shaft sleeve comprises:
a sleeve bore configured to receive an end of a golf club shaft;
a sleeve axis extending along a longitudinal centerline of the sleeve bore;
a sleeve top portion comprising a sleeve top end;
a sleeve insertion portion insertable into the hosel and comprising a sleeve wall bounding the sleeve bore; and
a sleeve top coupler bounding the shaft sleeve between the sleeve top portion and the sleeve insertion portion;
the hosel comprises:
a hosel inner wall defining a hosel bore configured to receive the sleeve insertion portion of the shaft sleeve;
a hosel axis extending along a longitudinal centerline of the hosel bore; and
a hosel top portion atop the hosel inner wall and comprising:
a hosel top coupler configured to couple with the sleeve top coupler when the shaft sleeve is located in the hosel;
the first washer securing mechanism comprises:
a sleeve bottom coupler at a bottom of the shaft sleeve;
a locking surface of the head body;
a passageway located at a bottom end of the hosel, linking the hosel bore to the locking surface of the head body, and bounded by a passageway perimeter at the locking surface,
the passageway perimeter comprising a passageway centerpoint;
a fastener configured to engage the sleeve bottom coupler via the passageway to pull the sleeve top coupler and the hosel top coupler against each other and to secure the sleeve axis relative to the hosel axis; and
a first washer located between the fastener and the locking surface;
the first washer comprising:
a first washer side comprising a first washer form having a shape that is noncircular and complementary with the passageway perimeter;
a second washer side opposite the first washer side; and
a first washer channel extending from the first washer side to the second washer side;
the first washer form configured to engage the passageway perimeter in:
a first orientation configured to position the first washer channel at a first location, relative to the passageway centerpoint, for setting the sleeve axis at a first angle relative to the hosel axis when the fastener and the sleeve bottom coupler engage each other via the passageway and the first washer channel;
wherein:
the second washer side of the first washer comprises a second washer form having a shape that is noncircular and complementary with the passageway perimeter; and
the second washer form is configured to engage the passageway perimeter in:
a second orientation configured to position the first washer channel at a second location, relative to the passageway centerpoint, for setting the sleeve axis at a second angle relative to the hosel axis when the fastener and the sleeve bottom coupler engage each other via the passageway and the first washer channel.

2. A golf club head comprising:
a head body;
a hosel at the head body;
a shaft sleeve removable from the hosel; and
an adjustment mechanism comprising a first pivoting mechanism;
wherein:
the shaft sleeve comprises:
a sleeve bore configured to receive an end of a golf club shaft;
a sleeve axis extending along a longitudinal centerline of the sleeve bore;
a sleeve top portion comprising a sleeve top end;
a sleeve insertion portion insertable into the hosel and comprising a sleeve wall bounding the sleeve bore; and
a sleeve top coupler bounding the shaft sleeve between the sleeve top portion and the sleeve insertion portion;

the hosel comprises:

a hosel inner wall defining a hosel bore configured to receive the sleeve insertion portion of the shaft sleeve;

a hosel axis extending along a longitudinal centerline of the hosel bore; and a hosel top portion atop the hosel inner wall and comprising:

a hosel top coupler configured to couple with the sleeve top coupler when the shaft sleeve is located in the hosel;

the first pivoting mechanism comprises:

the sleeve top coupler comprising an arcuate joint surface substantially conforming to a spherical segment shape; and the hosel top coupler comprising an arcuate socket surface substantially conforming to the spherical segment shape such that, when the sleeve insertion portion is in the hosel bore, the arcuate joint surface of the sleeve top coupler and the arcuate socket surface of the hosel top coupler are configured to slidably seat against each other, thereby defining a pivot junction therebetween to enable displacement of the sleeve insertion portion along a plurality of planes within the hosel bore;

the sleeve top coupler comprises:

a sleeve first keyway element at the arcuate joint surface and comprising one of:

a sleeve first keyway slot extending along a first plane comprising the sleeve axis; or a sleeve first keyway key protruding from the arcuate joint surface;

and a sleeve second keyway element at the arcuate joint surface;

the hosel top coupler comprises:

a hosel first keyway element at the arcuate socket surface and comprising one of:

a hosel first keyway key when the sleeve first keyway element comprises the sleeve first keyway slot, the hosel first keyway key protruding from the arcuate socket surface to slidably engage with the sleeve first keyway slot; or a hosel first keyway slot when the sleeve first keyway element comprises the sleeve first keyway key, the hosel first keyway slot extending along the first plane comprising the hosel axis to slidably engage with the sleeve first keyway key;

and a hosel second keyway element at the arcuate socket surface;

the sleeve first keyway element and the hosel first keyway element are complementary to each other and configured to slidably engage each other;

the sleeve second keyway element and the hosel second keyway element are complementary to each other and configured to slidably engage each other; and when the sleeve first keyway element is engaged with the hosel first keyway element, and the sleeve second keyway element is engaged with the hosel second keyway element:

the shaft sleeve is restricted from rotating about the hosel axis; and the shaft sleeve is pivotable relative to the hosel bore, along the plurality of planes.

3. A golf club head comprising:

a head body;

a hosel at the head body; and a shaft sleeve removable from the hosel;

wherein:

the shaft sleeve comprises:

a sleeve bore configured to receive an end of a golf club shaft;

a sleeve axis extending along a longitudinal centerline of the sleeve bore;

a sleeve top portion comprising a sleeve top end;

a sleeve insertion portion insertable into the hosel and comprising a sleeve wall bounding the sleeve bore; and a sleeve top coupler bounding the shaft sleeve between the sleeve top portion and the sleeve insertion portion;

wherein the sleeve top coupler comprises:

an arcuate joint surface substantially conforming to a spheroidal segment shape;

a sleeve first keyway element at the arcuate joint surface and comprising one of:

a sleeve first keyway slot extending along a first plane comprising the sleeve axis; or a sleeve first keyway key protruding from the arcuate joint surface;

the hosel comprises:

a hosel inner wall defining a hosel bore configured to receive the sleeve insertion portion of the shaft sleeve;

a hosel axis extending along a longitudinal centerline of the hosel bore; and a hosel top portion above the hosel inner wall and comprising:

a hosel top coupler configured to couple with the sleeve top coupler when the shaft sleeve is located in the hosel;

the hosel top coupler comprises:

an arcuate socket surface substantially conforming to the spheroidal segment shape; and when the sleeve insertion portion is located in the hosel bore the arcuate joint surface of the sleeve top coupler and the arcuate socket surface of the hosel top coupler slidably seat against each other to define a pivot junction therebetween, the pivot junction enabling displacement of the sleeve insertion portion along a plurality of planes within the hosel bore;

a hosel first keyway element at the arcuate socket surface and comprising one of:

a hosel first keyway key when the sleeve first keyway element comprises the sleeve first keyway slot, the hosel first keyway key protruding from the arcuate socket surface to slidably engage with the sleeve first keyway slot;

or a hosel first keyway slot when the sleeve first keyway element comprises the sleeve first keyway key, the hosel first keyway slot extending along the first plane comprising the hosel axis to slidably engage with the sleeve first keyway key; and when engaged with each other, the sleeve first keyway element and the hosel first keyway element restrict a rotation of the shaft sleeve about the hosel axis and permit the displacement of the sleeve insertion portion along a plurality of planes within the hosel bore.

4. The golf club head of claim 3, wherein:

the sleeve top coupler further comprises:

a sleeve second keyway element at the arcuate joint surface;

the hosel top coupler comprises:

a hosel second keyway element at the arcuate socket surface;

the sleeve second keyway element and the hosel second keyway element are complementary to each other and configured to slidably engage each other;

when the sleeve first keyway element is engaged with the hosel first keyway element, and the sleeve second keyway element is engaged with the hosel second keyway element, the sleeve second keyway element and the hosel second keyway element:

restrict the rotation of the shaft sleeve about the hosel axis; and permit the pivoting of the shaft sleeve along the plurality of planes.

5. The golf club head of claim 4, wherein:

the hosel first keyway element and the hosel second keyway element are located 180 degrees apart from each other along the arcuate socket surface of the hosel top coupler.

6. The golf club head of claim 4, wherein:

the sleeve top coupler further comprises:

a sleeve third keyway element at the arcuate joint surface;

a sleeve fourth keyway element at the arcuate joint surface;

the hosel top coupler comprises:

a hosel third keyway element at the arcuate socket surface;

a hosel fourth keyway element at the arcuate socket surface;

the sleeve third keyway element and the hosel third keyway element are complementary to each other and configured to slidably engage each other;

the sleeve fourth keyway element and the hosel fourth keyway element are complementary to each other and configured to slidably engage each other;

the hosel first keyway element and the hosel second keyway element are located 180 degrees apart from each other along the arcuate socket surface of the hosel top coupler;

the hosel third keyway element and the hosel fourth keyway element are located 180 degrees apart from each other along the arcuate socket surface of the hosel top coupler;

when the sleeve first keyway element is engaged with the hosel first keyway element, the sleeve second keyway element is engaged with the hosel second keyway element, the sleeve third keyway element is engaged with the hosel third keyway element, and the sleeve fourth keyway element is engaged with the hosel fourth keyway element, the sleeve third keyway element and the hosel third keyway element, along with the sleeve fourth keyway element and the hosel fourth keyway element:

restrict the rotation of the shaft sleeve about the hosel axis; and permit the pivoting of the shaft sleeve along the plurality of planes.

7. The golf club head of claim 3, further comprising:

a securing mechanism configured pull the sleeve top coupler and the hosel top coupler against each other and to secure the sleeve axis at a first angle relative to the hosel axis;

wherein:

the securing mechanism comprises:

a sleeve bottom coupler at a bottom of the shaft sleeve;

a locking surface of the head body;

a passageway located at a bottom end of the hosel, linking the hosel bore to the locking surface of the head body; and a fastener;

and the fastener and the sleeve bottom coupler are configured to engage each other via the passageway and the locking surface.

8. The golf club head of claim 7, wherein:

the fastener comprises one of a male threaded fastener or a female threaded; and the sleeve bottom coupler comprises a different one of the male threaded fastener or the female threaded fastener.

9. The golf club head of claim 7, wherein:

the securing mechanism comprises a washer;

the locking surface comprises a passageway perimeter bounding the passageway;

the passageway perimeter comprises a passageway centerpoint;

the washer comprises:

a first washer side comprising a first washer form complementary to the passageway perimeter;

a second washer side opposite the first washer side; and a first washer channel extending from the first washer side to the second washer side;

and the first washer form is configured to engage the passageway perimeter in a first orientation configured to position the first washer channel at a first location, relative to the passageway centerpoint, for setting the sleeve axis at the first angle relative to the hosel axis when the fastener and the sleeve bottom coupler engage each other via the passageway and the first washer channel.

10. The golf club head of claim 9, wherein:

the second washer side of the washer comprises a second washer form complementary to the passageway perimeter; and the second washer form is configured to engage the passageway perimeter in a second orientation configured to position the first washer channel at a second location, relative to the passageway centerpoint, for setting the sleeve axis at a second angle relative to the hosel axis when the fastener and the sleeve bottom coupler engage each other via the passageway and the first washer channel.

11. The golf club head of claim 10, wherein:

the second washer form is configured to engage the passageway perimeter in a third orientation configured to position the first washer channel at a third location, relative to the passageway centerpoint, for setting the sleeve axis at a third angle relative to the hosel axis when the fastener and the sleeve bottom coupler engage each other via the passageway and the first washer channel.

12. The golf club head of claim 11, wherein:

the second and third orientations differ from each other by approximately 180 degrees.

13. The golf club head of claim 11, wherein:

the second washer form is configured to engage the passageway perimeter in:

a fourth orientation configured to position the first washer channel at a fourth location, relative to the passageway centerpoint, for setting the sleeve axis at a fourth angle relative to the hosel axis; and a fifth orientation configured to position the first washer channel at a fifth location, relative to the passageway centerpoint, for setting the sleeve axis at a fifth angle relative to the hosel axis.

14. The golf club head of claim 13, wherein:

the second and third orientations of the second washer form differ from each other, relative to the passageway centerpoint, by approximately 180 degrees; and the fourth and fifth orientations of the second washer form differ from each other, relative to the passageway centerpoint, by approximately 180 degrees.

15. The golf club head of claim 10, wherein:

the first washer form and the second washer form are offset from each other such that:

at the first washer side, the first washer channel is substantially centered relative to the first washer form; and at the second washer side, the first washer channel is non-centered relative to the second washer form.

16. The golf club head of claim 9, wherein:

the washer is configured to engage the passageway perimeter in 3 different orientations configured to position the sleeve axis at 3 different angles relative to the hosel axis.

17. The golf club head of claim 9, wherein:

the washer is configured to engage the passageway perimeter in 5 different orientations configured to position the sleeve axis at 5 different angles relative to the hosel axis.

18. The golf club head of claim 9, wherein:

the washer is configured to engage the passageway perimeter in 4 different orientations configured to position the sleeve axis at 5 different angles relative to the hosel axis.

19. The golf club head of claim 9, wherein:

the first washer form and the passageway perimeter comprise non-circular complementary borders configured to restrict rotation of the washer relative to the locking surface.

20. A method for providing a golf club head, the method comprising:

providing a head body;

providing a hosel at the head body; and providing a shaft sleeve removable from the hosel;

wherein:

providing the shaft sleeve comprises:

providing a sleeve bore configured to receive an end of a golf club shaft;

providing a sleeve axis extending along a longitudinal centerline of the sleeve bore;

providing a sleeve top portion comprising a sleeve top end;

providing a sleeve insertion portion insertable into the hosel and comprising a sleeve wall bounding the sleeve bore; and providing a sleeve top coupler bounding the shaft sleeve between the sleeve top portion and the sleeve insertion portion;

providing the sleeve top coupler comprises:

providing an arcuate joint surface substantially conforming to a spheroidal segment shape;

providing the hosel comprises:

providing a hosel inner wall defining a hosel bore configured to receive the sleeve insertion portion of the shaft sleeve;

providing a hosel axis extending along a longitudinal centerline of the hosel bore; and providing a hosel top portion above the hosel inner wall and comprising:

a hosel top coupler configured to couple with the sleeve top coupler when the shaft sleeve is located in the hosel;

and providing the hosel top coupler comprises:

providing an arcuate socket surface substantially conforming to the spheroidal segment shape such that, when the sleeve insertion portion is located in the hosel bore, the arcuate joint surface of the sleeve top coupler and the arcuate socket surface of the hosel top coupler slidably seat against each other, thereby defining a pivot junction therebetween to enable displacement of the sleeve insertion portion within the hosel bore;

providing a securing mechanism configured pull the sleeve top coupler and the hosel top coupler against each other and to secure the sleeve axis relative to the hosel axis;

wherein:

providing the securing mechanism comprises:

providing a sleeve bottom coupler at a bottom of the shaft sleeve;

providing a locking surface of the head body;

providing a passageway located at a bottom end of the hosel, linking the hosel bore to the locking surface of the head body;

providing a fastener; and providing a first washer between the fastener and the locking surface, wherein:

providing the first washer comprises:

providing a first washer side of the washer comprising a first washer form having a shape that is noncircular and complementary with the passageway perimeter;

providing a second washer side opposite the first washer side; and providing a first washer channel extending from the first washer side to the second washer side;

providing the locking surface comprises:

providing a passageway perimeter bounding the passageway and comprising a passageway centerpoint;

providing the first washer side of the washer comprises:

providing a first washer form complementary to the passageway perimeter and configured to engage the passageway perimeter in a first orientation for positioning the first washer channel at a first location, relative to the passageway centerpoint, to set the sleeve axis at a first angle relative to the hosel axis when the fastener and the sleeve bottom coupler engage each other via the passageway and the first washer channel;

and providing the second washer side of the washer comprises:

providing a second washer form having a shape that is noncircular and complementary to the passageway perimeter and configured to engage the passageway perimeter in a second orientation for positioning the first washer channel at a second location, relative to the passageway centerpoint, to set the sleeve axis at a second angle relative to the hosel axis when the fastener and the sleeve bottom coupler engage each other via the passageway and the first washer channel.

* * * * *